United States Patent [19]

Shah et al.

[11] 4,350,238

[45] Sep. 21, 1982

[54] DATA ACQUISITION UNIT

[75] Inventors: Hasmukh R. Shah, Hot Springs, Ark.; Thaddeus M. Jones; Bruce Hemingway, both of South Bend, Ind.

[73] Assignee: UMC Industries, Inc., Stamford, Conn.

[21] Appl. No.: 137,436

[22] Filed: Apr. 4, 1980

[51] Int. Cl.[3] ..... G07F 9/08

[52] U.S. Cl. ..... 194/1 N; 221/7; 235/92 CN; 364/479

[58] Field of Search ..... 194/1 L, 1 M, 1 N; 221/2, 7, 129; 364/403, 404, 406, 478, 479; 235/92 AC, 92 CN

[56] References Cited

U.S. PATENT DOCUMENTS

| | | | |
|---|---|---|---|
| 4,038,525 | 7/1977 | Freeman | 235/92 CN |
| 4,143,749 | 3/1979 | Otten | 194/1 N |
| 4,146,778 | 3/1979 | Wain | 194/1 N X |
| 4,216,461 | 8/1980 | Werth et al. | 364/479 X |
| 4,231,105 | 10/1980 | Schuller et al. | 364/479 X |
| 4,233,660 | 11/1980 | Fagan | 364/479 X |

*Primary Examiner*—Robert J. Spar
*Assistant Examiner*—Edward M. Wacyra
*Attorney, Agent, or Firm*—Senniger, Powers, Leavitt and Roedel

[57] ABSTRACT

A data acquisition unit accepts serial bit streams from a control device for a vending machine, and it records the data represented by those serial bit streams. The data in one of those serial bit streams will include the number of vends of each product corresponding to the various selection switches of the vending machine, and the data in the other of those serial bit streams will include the price data. The data acquisition unit will store the price data in a non-resettable location and also in a resettable location. A readout can be actuated to effect the displaying of the selection line number and of the corresponding settable and non-resettable price data.

21 Claims, 15 Drawing Figures

50
+24V
82
52
P5-6
78
80
90
84
161
33
51
96
P4-3
163
154
156
158
L6
94
102
31
+5V
160
100
104
62
P4-4
92
162
98
106
110
P1-6
OUT
X0
X1
X2
X3
X4
X5
X6
X7
P5-0
P5-1
P5-2
P5-3
A
B
C
INH.
108
112
P1-7
114
136
P0-0
54
116
P0-1
56
118
P0-2
58
120
P0-3
60
122
P0-4
63
124
P0-5
64
126
P0-6
66
128
P0-7
68
130
P1-0
70
132
138
140
P1-1
72
134
P4-5
142
P4-6
144
P4-0
146

DATA ACQUISITION UNIT

BACKGROUND OF THE INVENTION

It is desirable to have a permanent, readily-available record of the number of vends of each product corresponding to the various selection switches of a vending machine; and it also is desirable to have a permanent, readily-available record of the total prices at which those products were vended. Various totalizers have been proposed which could be incorporated into vending machines to respond to vending operations to step up a counter which could be suitably read. However, the data provided by such devices, and the manner of supplying that data, have not been truly satisfactory.

SUMMARY OF THE INVENTION

The present invention mounts a data acquisition unit within a vending machine and connects it to the control device of that vending machine so it can receive serial bit streams from that control device. The data in one of those serial bit streams will include the number of vends of each product corresponding to the various selection switches of the vending machine, and the data in the other of those serial bit streams will include the price data. The data represented by the serial bit streams is recorded in two locations, one of which is re-settable, and the other of which is not resettable. A data-accepting unit can be connected to said data acquisition unit to accept corresponding data from said data acquisition unit. It is, therefore, an object of the present invention to provide a data acquisition unit which is connectable to the control device of a vending machine and which can transfer data to a data-accepting unit.

The data acquisition unit provided by the present invention is able, while it is in a data-yielding mode, to cause a printer to make a printout. That data acquisition unit can, while in said data-yielding mode, supply data to said printer without destroying or altering said data, whereby said printer can make duplicate, identical copies of printouts. It is therefore, an object of the present invention to provide a data acquisition unit which is able, while it is in a data-yielding mode, to supply data to a printer without destroying or altering said data, whereby that printer can make identical duplicate copies of printouts.

The data acquisition unit provided by the present invention is placed in a data-yielding mode by the closing of a circuit. That data acquisition unit will remain in that mode even after that circuit is re-opened. However, that data acquisition unit will respond to a subsequent vending operation of the vending machine, with which that data acquisition unit is used, to automatically shift out of said data-yielding mode.

The data acquisition unit provided by the present invention maintains a non-resettable record of the approximate length of time the vending machine, with which that data acquisition unit is used, has been in service. That record is printed on each printout, and hence aids in the interpretation of those printouts. It is, therefore, an object of the present invention to provide a data acquisition unit which maintains a non-resettable record of the approximate length of time the vending machine, with which that data acquisition unit is used, has been in service.

The data acquisition unit provided by the present invention senses and stores the number of times the electric power, that normally is supplied to it, is interrupted. The printout, which is made from data supplied by the data acquisition unit, directly indicates how many times power was interrupted between the time the printout was made and the last time data was unloaded from that data acquisition unit. That information could be very helpful in high-lighting attempts of persons to cheat the vending machine by "jiggling" the line cord. Also, that information could indicate if someone was trying to cheat the machine by disconnecting the data acquisition unit. It is, therefore, an object of the present invention to provide a data acquisition unit which will sense and record power interruptions.

The data acquisition unit of the present invention normally maintains a relay coil energized to complete a circuit of the control device of the vending machine. If, for any reason, the data acquisition unit were to be disconnected from power, were to experience a failure which could remove power from that relay coil, or were to be disconnected from the vending machine, that vending machine would be unable to accept coins. As a result, it would be virtually impossible for someone to disable the data acquisition unit without also disabling the vending machine. It is, therefore, an object of the present invention to provide a data acquisition unit which normally maintains a relay coil energized to complete a circuit of the control device of a vending machine.

The data acquisition unit provided by the present invention can be used with vending machines having a very large number—thirty-two (32)—of selection lines. However, that data acquisition unit also is usable with vending machines that have fewer selection lines; and it can automatically cause a printout to have a length that is proportional to the number of selection lines of the vending machine.

The data acquisition unit provided by the present invention receives all of its price data from the vending machine; and hence the data in that data acquisition unit will directly reflect price data corresponding to operations of that vending machine. As a result, when any of the prices of products are changed, the data which is received and stored by the data acquisition unit will automatically reflect the changed prices. It is, therefore, an object of the present invention to provide a data acquisition unit which receives all of its price data from the vending machine.

Other and further objects and advantages of the present invention should become apparent from an examination of the drawing and accompanying description.

In the drawing and accompanying description, two embodiments of the present invention are shown and described, but it is to be understood that the drawing and accompanying description are for the purpose of illustration only and do not limit the invention and that the invention will be defined by the appended claims.

COMPONENTS

Figure 1:
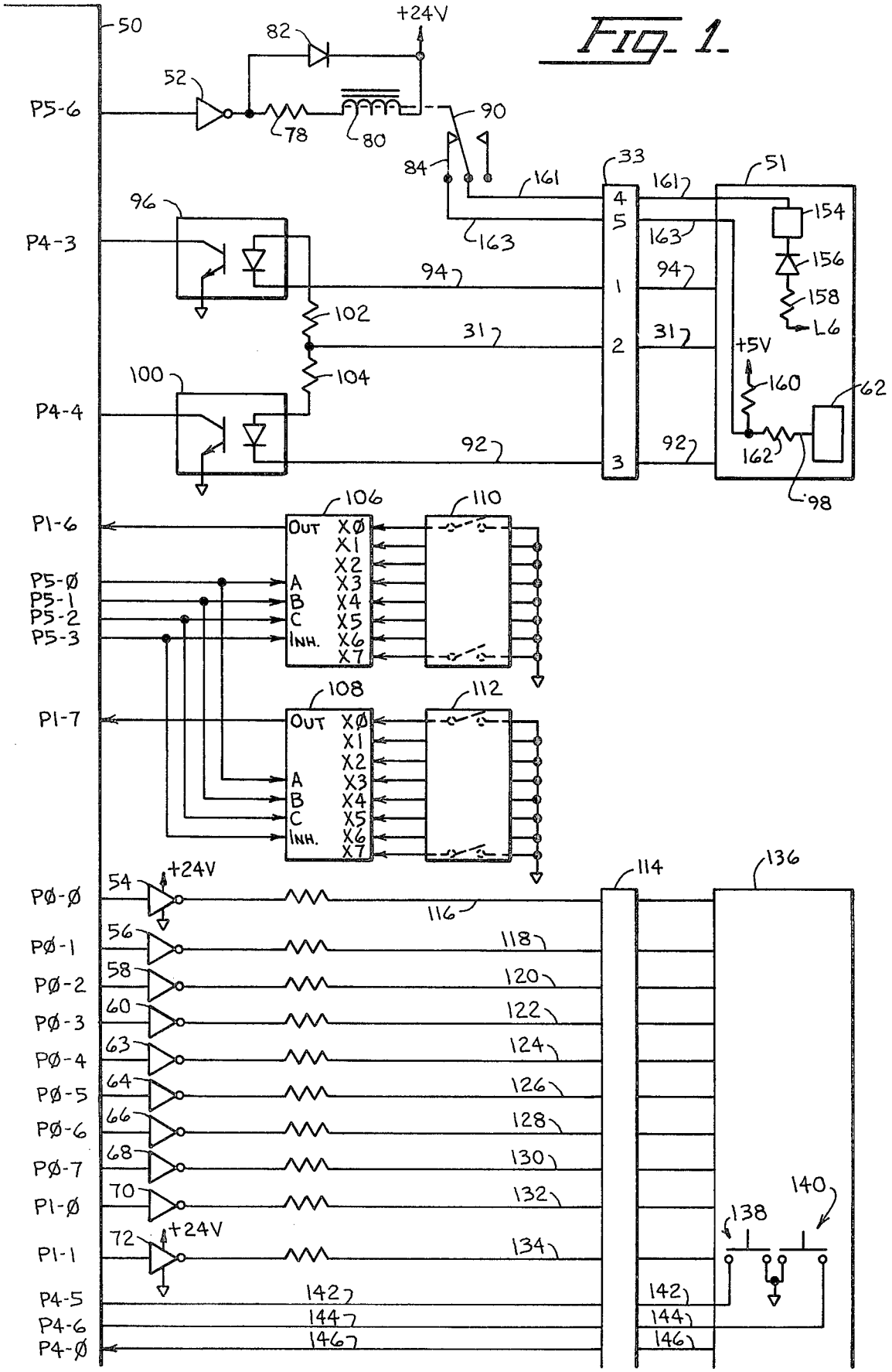
FIGS. 1 and 2 show the circuit for one embodiment of data acquisition unit which is made in accordance with the principles and teachings of the present invention, FIGS. 3–14 constitute a flow chart of the operation of that data acquisition unit.

The numeral 50 denotes a microprocessor which is one part of a microcomputer module that is connected to a coin changer 51 for a vending machine by a plug and socket 33 and conductors 31, 92, 94, 161 and 163. Although that microprocessor has been shown larger than that coin changer, the overall module which includes that microprocessor is smaller than that coin changer; and both that module and that coin changer will be mounted within the same vending machine. That module includes, among other things, a Fairchild F8 3850CPU, a Fairchild F8 3853SMI, a Fairchild F8 3861PIO, a PROM, a RAM and a back-up battery. The numerals 52, 54, 56, 58, 60, 63, 64, 66, 68, 70, 72, 74 and 76 denote inverter drivers. Although various inverter drivers could be used, it is desirable to use a Sprague Electronic ULN2003N as seven of those inverter drivers, and to use six-sevenths of another ULN2003N as six of those inverter drivers.

Pin 6 of Port 5 of microprocessor 50 can supply a "relay enable" signal to the input of inverter driver 52; and a resistor 78 and a relay coil 80 are connected between the output of that driver and plus twenty-four (+24) volts. A flyback diode 82 is connected in parallel with the series-connected resistor 78 and coil 80. The numeral 84 denotes a stationary contact which is connected, via conductor 163, plug and socket 33, resistor 162 and conductor 98, to pin 6 of Port 4 of a microprocessor 62 of a control device for a vending machine. A pull up resistor 160 connects the conductor 98 to plus five (+5) volts. The numeral 90 denotes a movable contact which is biased for movement out of engagement with the contact 84, but which is pulled into engagement with that contact whenever relay coil 80 is energized. That movable contact is connected by a conductor 161 and the plug and socket 33 to an opto-coupler 154 which receives a signal from a line L6 of a vending machine via a resistor 158 and a diode 156. Although various devices could be used, the microprocessor 62, resistors 158, 160 and 162, opto-coupler 154 and diode 156 preferably are identical to the similarly-numbered components in Hasmukh R. Shah et al application for Control Device, Serial No. 137,524, filed of even date.

The plug and socket 33 have five pins; and pins 4 thereof interconnect sections of conductor 161, and pins 5 thereof interconnect sections of conductor 163. The numerals 96 and 100 denote opto-couplers; and resistors 102 and 104 connect one input terminal of each of those opto-couplers to the conductor 31 which is connected by plug and socket 33 to a source of plus twelve (+12) volts in the changer 51. The other input terminal of opto-coupler 96 is connected by conductor 94 and plug and socket 33 to pin 1 of Port 5 of the microprocessor 62 of said Shah et al application. The other input terminal of opto-coupler 100 is connected by conductor 92 and plug and socket 33 to pin 4 of Port 5 of the microprocessor 62 of said Shah et al application. The emitters of the phototransistors of each of the opto-couplers 96 and 100 are grounded. The output of opto-coupler 96 is connected to pin 3 of Port 4 of microprocessor 50; and that opto-coupler will supply to that pin a serial bit stream wherein each bit will represent five cents (5¢). The output of opto-coupler 100 is connected to pin 4 of Port 4 of microprocessor 50; and that opto-coupler will supply to that pin a signal which will identify the selection switch that initiated the vending operation which led to the serial bit stream on conductors 92 and 94.

The numerals 106 and 108 denote two eight channel multiplex/demultiplexers (hereinafter MUX); and each of them has its A, B, C and INH inputs connected, respectively, to pins 0–3 of Port 5 of microprocessor 50. The 0 through 7 pins of MUX 106 are connected to eight position DIP switches 110; and the 0 through 7 pins of MUX 108 are connected to eight position DIP switches 112. The contacts of those switches can be set to provide a binary code which will positively identify the vending machine in which the data acquisition unit is located. Pins 0 through 3 of Port 5 of microprocessor 50 supply successive binary words to the A,B,C and INH inputs of each MUX, and thereby selectively connect switches in the DIP switches 110 or 112 to the Out pin of that MUX.

Conductors 116, 118, 120, 122, 124, 126, 128, 130, 132 and 134 and plug and socket 114 and current-limiting resistors connect the outputs of inverter drivers 54, 56, 58, 60, 63, 64, 66, 68, 70 and 72, respectively, to the inputs of a printer 136 to control the thermal elements in the print head of that printer. Although various MUX could be used as the MUX 106 and 108, two Motorola MC14051B eight channel multiplexer/demultiplexers are preferred. Although various printers could be used as the printer 136, an Olivetti Model PU1800/B/18 thermal printer is preferred.

The numeral 138 denotes a normally-open push button switch which has one terminal thereof grounded, and which has the other terminal thereof connected, by a conductor 142 and plug and socket 114, to pin 5 of Port 4 of microprocessor 50. The closing of that switch will supply a signal to microprocessor 50 which will produce a command to printer 136 to print. The numeral 140 denotes a further normally-open push button switch which has one terminal thereof grounded, and which has the other terminal thereof connected, by a conductor 144 and plug and socket 114, to pin 6 of Port 4 of that microprocessor. Closing of that switch will apply a "stop print" command to microprocessor 50.

Conductors 146, 148, and 150 and plug and socket 114 connect pins 0–2 of Port 4 of the microprocessor 50 to the printer 136. Conductor 146 will provide a "start" strobe to pin 0 of Port 4 of that microprocessor when the printing unit of the printer 136 is in position to start printing a fresh line. Conductor 148 will provide a "P1" strobe to pin 1 of Port 4 each time the printing unit is in position to start printing the dots which help define the odd-numbered dots in a given row. Because the printing unit prints as it moves from right to left, as well as when it moves from left to right, the P1 strobe will occur at opposite sides of digits in adjacent rows. The numeral 150 denotes a conductor which supplies a "P2" strobe to pin 2 of Port 4 each time the printing unit is in position to start printing the even-numbered dots in a given row.

The numeral 170 denotes a Darlington amplifier; and one Darlington amplifier that is very useful is a Texas Instruments TIP-110. The numeral 192 denotes a similar Darlington amplifier.

A resistor 182, an adjustable resistor 184, and a resistor 196 are connected between the output of Darlington amplifier 170 and ground. Resistors 172 and 174 are connected in series between plug twenty-four (+24) volts and the collector of an NPN transistor 176. The junction between those resistors is connected to the input of Darlington amplifier 170; and the junction between adjustable resistor 184 and resistor 196 is connected to the base of transistor 176. A resistor 188 and a Zener diode 178 are connected between plus twenty-four (+24) volts and ground; and the junction between them is connected to the emitter of transistor 190. A resistor 204, an adjustable resistor 206 and a resistor 208 are connected in series between plus twenty-four (+24) volts and ground. A resistor 194 and transistor 190 are connected between plus twenty-four (+24) volts and the cathode of Zener diode 178; and the junction between that resistor and that transistor is connected to the input of Darlington amplifier 192. The junction between adjustable resistor 206 and resistor 208 is connected to the base of transistor 190.

The Darlington amplifier 170, transistor 176 and their associated resistors serve as a "keyed" power supply—in the sense that they can be turned "on" and "off" very rapidly. Similarly, the Darlington amplifier 192, transistor 190 and their associated resistors serve as a "keyed" power supply—in the sense that they can be turned "on" and "off" very rapidly. The Zener diode 178 provides a fixed reference voltage for the two "keyed" power supplies. Resistor 188 provides a bias current for that Zener diode; and hence that Zener diode is able to provide a reference voltage which is essentially independent of the conductive or non-conductive states of the transistors 176 and 190. Inverter 74 connects pin 7 of Port 5 of microprocessor 50 to the input of Darlington amplifier 170; and inverter 76 connects that pin to the input of Darlington amplifier 192. A capacitor 180 is connected between the output of inverter 74 and ground; and, similarly, a capacitor 198 is connected between the output of inverter 76 and ground.

A conductor 186 extends from the output of Darlington amplifier 170 to the thermal heads of printer 136 via plug and socket 114; and that conductor can supply an excitation voltage to those thermal heads. That voltage can be turned "on" or "off" by the logic level at pin 7 of Port 5; but the value of that voltage will be controlled by the setting of adjustable resistor 184. Specifically, that adjustable resistor and resistors 182 and 196 constitute a voltage divider which is connected between conductor 186 and ground; and the voltage at the upper terminal of resistor 196 is applied to the base of transistor 176. That transistor amplifies any difference between the voltages across Zener diode 178 and resistor 196; and, if the voltage across resistor 196 tends to be greater than that across Zener diode 178, transistor 176 will become more conductive. The resulting increase in IR drop across resistor 172 will decrease the input voltage of Darlington amplifier 170; and the consequent reduced conductivity of that Darlington amplifier will decrease the voltage on conductor 186 to the desired value. As a result, the Darlington amplifier, transistor 176 and their associated resistors constitute a voltage regulator as well as a "keyed" power supply.

Capacitor 180 and resistor 174 provide high-frequency compensation for that combination voltage regulator and "keyed" power supply. As a result, they made certain that no oscillations can develop.

Similarly, the Darlington amplifier 192, transistor 190 and their associated resistors constitute a voltage regulator as well as a "keyed" power supply. A conductor 210 and plug and socket 114 will apply any voltage at the output of Darlington amplifier 192 to the printer 136; and that voltage will be the supply voltage for the motor of that printer. The capacitor 198 will provide high-frequency compensation for that combination voltage regulator and "keyed" power supply. As a result, it makes certain that no oscillation can develop.

When pin 7 of Port 5 of microprocessor 50 applies a logic "1" to the inputs of inverters 74 and 76, the resulting "0"s will be applied to the inputs of the Darlington amplifiers 170 and 192. The outputs of those Darlington amplifiers also will be "0"s, and hence the thermal heads and the motor of printer 136 will not be excited. However, if pin 7 of Port 5 applies a logic "0" to the inputs of inverters 74 and 76, the resulting "1"s at the inputs of the Darlington amplifier will start the motor of printer 136 and will make power available to the thermal heads of that printer. Significantly, the states of pins 0 through 7 of Port 0 and the states of pins 0 and 1 of Port 1 of microprocessor 50 will determine which, if any, of those thermal heads can be excited.

A resistor 202 and a diode 200 are connected in series relation between the output and input of Darlington amplifier 192; and they will coact with that Darlington amplifier to provide dynamic braking for the motor of printer 136. Specifically, whenever the logic state of pin 7 of Port 5 changes from "0" to "1", the voltages at the input and output of Darlington amplifier 192 will drop to zero (0). Thereupon, the series-connectd diode 200 and resistor 202 will be grounded by inverter 76; and hence the inductive energy in the motor will be passed to ground. Although the motor of the printer was, at the instant the logic state of pin 7 of Port 5 changed from "0" to "1", operating at its rated speed, the rotor of that motor will stop almost immediately. The numeral 300 in FIG. 3 denotes the step of applying power to the coin changer 51 and to the microprocessor 50. The numeral 302 denotes the initialization of all ports of that microprocessor. In step 304, wherein power is re-applied after each accidental cutting off of power, the HEX 200A register of step 304 will respond to the execution of that step to increment the count in that register. As a result, that count constitutes a running record of the number of "turn ons" since the last time data was withdrawn from the data acquisition unit. That count can be important in high-lighting attempts of persons to "cheat" the vending machine or the data acquisition unit by "jiggling" the electric plugs in the sockets therefor. Also, that count can be important in high-lighting the number of times the vending machine or the data acquisition unit are turned off between periods when data is withdrawn from that data acquisition unit. Step 306 is entitled INIT. BUFFER CLEAR FLAG and it corresponds to lines 1090 through 1110 of the program. During that step, a flag—which can be set to effect the erasing of data in a data buffer—will be set to zero (0); and hence, during the executions of all steps of the program prior to the step wherein that flag is set, the data in that buffer will not be erased. Step 308 is entitled INIT. TIME BUFFER and it corresponds to lines 1140 through 1190 of the program. During that step, a timing function—which is intended to "time out" approximately once each hour—will be set to provide a full hour timing function even if, during a prior timing function, the power had failed and thereby permitted only a partial timing function to be performed. This means that the initialization of the data acquisition unit always provides a known starting time base. That timing function will automatically and continually repeat itself as long as the data acquisition unit is "on"—without any need of re-executing that step.

The numeral 310 denotes a step which is entitled VEND ENABLE RELAY ON and which corresponds to lines 1210 through 1220 of the program. During that step, the logic state of pin 6 of Port 5 of microprocessor 50 will be set to energize relay coil 80 of FIG. 1. Thereupon, movable contact 90 will shift into engagement with contact 84 to complete a circuit from line 6 of the vending machine via resistor 158, diode 156, opto-coupler 154, conductor 161, plug and socket 33, contacts 90 and 84, conductor 163, plug and socket 33, resistor 162 and conductor 98 to pin 6 of Port 4 of the microprocessor 62 in the coin changer 51. The energization of relay coil 80, and the consequent closing of contacts 90 and 84, will enable the coin changer 51 to accept coins.

Figure 3:
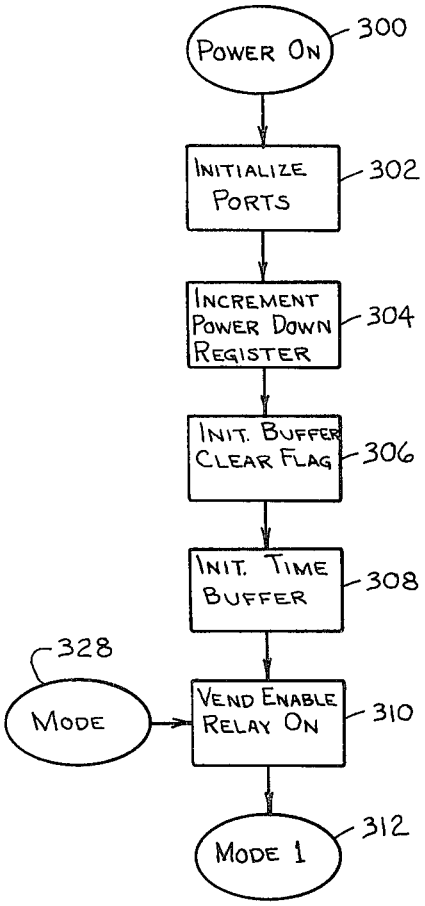
Figure 4:
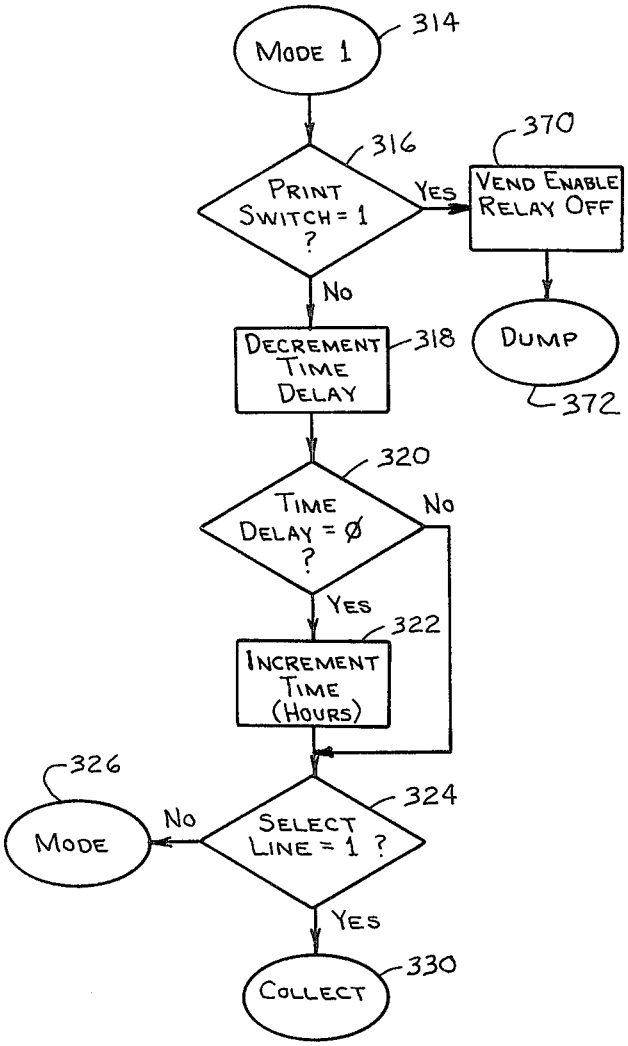

The numerals 312 and 314 denote connectives of FIGS. 3 and 4 which are entitled MODE 1 and which will cause the program to initiate the execution of step 316—which is entitled PRINT SWITCH=1? and which corresponds to lines 1300 through 1320 of the program. During that step, a comparing function will be performed to determine whether or not switch 138 of FIG. 1 is closed. If that comparing function provides a NO, step 318—which is entitled DECREMENT TIME DELAY and which corresponds to lines 1360 through 1460 of the program—will be executed. During that step, one of four registers of the time buffer, which were initialized during step 308, will be decremented. The count, which is initialized into those registers during step 308, will cause normal looping of the program to require an hour before that count is decremented to zero (0). The initializing and decrementing of the registers of step 318 will automatically and continually repeat themselves as long as the data acquisition unit is "on"—without any need of re-executing that step. Step 320 is entitled TIME DELAY=0? and it corresponds to line 1470 of the program; and, during that step, a comparing function will determine whether the registers of step 318 have been counted down to zero (0). Step 322 is entitled INCREMENT TIME (HOURS) and it corresponds to lines 1480 through 1630 of the program; and, during that step, the number of times the registers of step 318 have been incremented will be stored in the HEX 2002 and HEX 2003 RAM locations.

Step 324 is entitled SELECT LINE=1? and it corresponds to lines 1650 through 1670 of the program. If the comparing function of step 320 provided a YES, step 322 would increment the HEX 2002 and HEX 2003 locations which constitute a 14-bit timer register. However, when, as happens most frequently, the comparing function of step 320 provides a NO, step 322 will be bypassed; and step 324 will perform a comparing function to ascertain whether the logic state on conductor 92 of FIG. 1 is a "1". If that function provides a NO, MODE connectives 326 and 328, respectively, of FIGS. 4 and 3 will branch the program to step 310. That step will make certain that relay coil 80 of FIG. 1 is energized—thereby making certain that relay contacts 84 and 90 are closed. Steps 310, 316, 318, 320 and 324 constitute a loop which will be executed repeatedly through most of the time the data acquisition unit is "on". Specifically, that loop will be executed at all times when the registers of steps 308 and 318 are being decremented toward zero (0). Those registers will progressively decrement to zero (0), automatically initialize themselves to their originally-initialized count, and then start incrementing to zero (0). As a result, those registers will repeatedly and continually produce timing periods which will time out in approximately one hour. Each time one of those timing periods "times out", the time register of step 322 will be incremented to provide a running count of the number of times that time relay is decremented to zero (0).

Figure 5:
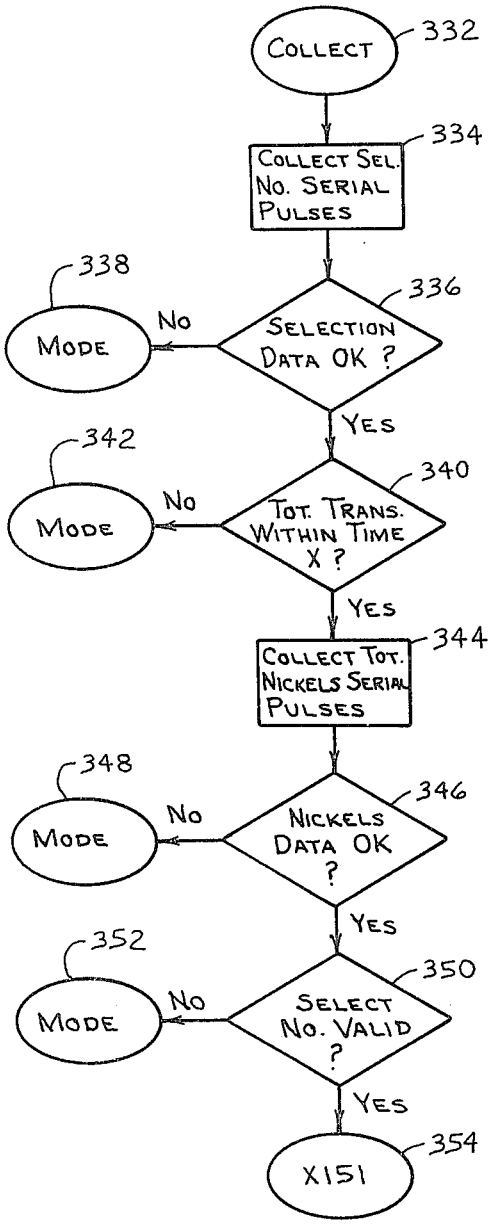

Whenever an execution of the routine of FIGS. 3 and 4 causes the comparing function of step 324 to provide a YES, the COLLECT connectives 330 and 332 of FIGS. 4 and 5 will initiate step 334 of FIG. 5—which is entitled COLLECT SEL. NO. SERIAL PULSES and which corresponds to steps 1710 through 2090 of the program. During that step, the number of pulses, which are supplied to pin 4 of Port 4 of microprocessor 50 by the microprocessor 62 via conductor 92 and opto-coupler 100, will be counted and then stored in register 3. Step 336 is entitled SELECTION DATA O.K.? and it corresponds to lines 1800 and 1880 of the program—and hence overlaps some of the lines of step 334. During that step, the width of each pulse on the conductor 92 is checked; and any pulse having less than a predetermined width will cause the whole series of pulses to be ignored, and also will cause the program to branch via mode connective 338 and connective 328, respectively, of FIGS. 5 and 3 to step 310. Thereupon, the program will loop through that step, the routine of FIG. 4, and step 334 of FIG. 5 to step 336 until a YES is provided by the latter step. The widths of the pulses on the conductor 92 should have a period (between the leading edges of adjacent pulses) of five milliseconds (5 ms); but step 336 will accept all pulses which have widths that are within twenty percent (20%), plus or minus, of that value.

Step 340 of FIG. 5 is entitled TOT. TRANS WITHIN TIME X, and it corresponds to lines 2100 through 2200 of the program. During that step, a determination will be made of whether the first price pulse, which the microprocessor 62 will apply to conductor 94, was received within fifty milliseconds (50 ms) of the last selection line pulse that was received on conductor 92. If the answer is NO, the coin changer 51 probably is in the "free vend mode"—wherein products can be dispensed by the vending machine but the money is handed directly to the operator rather than being inserted in the coin slot of that vending machine. In such event, the program will branch, via MODE connective 342 and connective 328, respectively, of FIGS. 5 and 3 to step 310 of FIG. 3. The program will then loop through that step and the routine of FIG. 4 until a logic "1" again appears on conductor 92.

Each selection switch of the vending machine is assigned a selection line number; and the lowest number is three (3)—to keep the pulses which are used to identify that selection line number from being simulated by a voltage spike, noise or another transient, as could happen if one of the selection line numbers was one (1). The number of selection lines in the control device of the said Shah et al application is thirteen (13); but the data acquisition unit of the present invention can store and supply data corresponding to as many as thirty-two (32) selection lines. The number corresponding to the last selection line of a vending machine having thirty-two (32) selection switches would be thirty-four (34). As a result, the number of pulses in each group of pulses that are received on conductor 92 in the form of a serial bit train with time periods of five milliseconds (5 ms) will constitute the number of a selection line plus two (2).

The numeral 344 denotes a step which is entitled COLLECT TOT. NICKELS SERIAL PULSES and which corresponds to lines 2220 through 2660 of the program. During that step the total number of bits, in the groups of bits of the serial bit stream which the microprocessor 62 applies to conductor 92, will be collected and stored in register 4. During step 346—which is entitled NICKELS DATA O.K.? and which corresponds to line 2340 of the program, and hence overlaps some of the lines of step 344—the widths of the pulses on conductor 94 will be checked. Those pulses have a time period of one hundred milliseconds (100 ms) and a duty cycle of fifty percent (50%). Any pulses which vary as much as twenty percent (20%), plus or minus, from that time period will be considered invalid pulses; and hence the program will branch, via MODE connective 348 and connective 328 of FIG. 3, to step 310 of FIG. 3. Thereupon, the program will loop—through that step, the routine of FIG. 4, and part of the routine of FIG. 4 to step 324—until pulses are again applied to conductor line 92 by microprocessor 62.

Step 350 of FIG. 5 is entitled SELECT NO. VALID? and it corresponds to lines 2670 through 2700 of the program. During that step, the number of pulses which are received on the conductor 92, during any serial bit stream, will be checked to determine whether or not that number exceeds the maximum number of selections that the data acquisition unit is capable of storing. If the answer is NO, the program will branch via MODE connective 352 and connective 328 in FIG. 3 to step 310 in FIG. 3; and then the program will loop through that step 310 and the routine of FIG. 4 to step 324 —until further pulses are noted on conductor 92. If a YES is produced by step 350, the program will branch, via X151 connective 354 and a similarly-identified connective 356 of FIG. 6, to step 358 of FIG. 6—which is entitled BUFFER CLEAR FLAG=TRUE? and which corresponds to lines 2720 through 2750 of the program. During that step, the state of the data buffer will be checked to determine whether an inventory function—wherein data was withdrawn from the data acquisition unit—had been performed. The initial state of the data buffer flag is set to "false" during step 306; and, if it still is "false", the program will branch to step 362 which is entitled ADD NICKELS TO TOTAL NICKELS and which corresponds to lines 3050 through 3070 of the program. If that buffer clear flag equals "true"—as it will after an inventory has been taken by the route man, the comparing function of step 358 will provide a YES; and then step 360, which is entitled CLEAR DATA BUFFER and which corresponds to lines 2790 through 3020 of the program, will clear sixty-five (65) buffers in the RAM in the microprocessor 50, which constitute a portion of the data buffer. At the conclusion of that clearing operation, step 360 will again set the buffer clear flag to "false". Consequently, during the next execution of step 358, the answer will be NO—and the program will by-pass step 360—unless a further inventory function has been performed. At this time, the program will have cleared all re-settable data from the data buffer, because all of that re-settable data would have been transferred to the printer 136 during an inventory function—all as explained hereinafter.

The data acquisition unit establishes and up-dates several groups of running counts—a non-resettable count of the number of times—"hours"—during which the time register of step 308 has been recurrently decremented to zero (0), a non-re-settable count of the total of the prices of all products vended by the vending machine—other than during "free vends", a group of non-re-settable running counts of the numbers of products which have been vended when each of the selection switches of the vending machine has been pressed, a group of non-re-settable running counts of the total of the prices of the products which have been vended when each of the selection switches of the vending machine has been pressed, a group of re-settable running counts of the numbers of products, which were vended since the last inventory function was performed, when each of the selection switches of the vending machine was pressed, a re-settable running count of the total of the prices of all products, which were vended since the last inventory function was performed, and a re-settable running count of the number of power interruptions since the last inventory function was performed. Those running counts constitute statistical data which can be important in the continued operation of the vending machine.

During step 362, some of the data which was received on conductor 94 as a serial bit stream will be added to the data in RAM locations HEX 2004 through HEX 2008. Specifically, the non-re-settable running count—of the total of the prices of all products vended by the vending machine, other than during "free vends" and which is stored in the HEX 2004 and HEX 2005 locations in the RAM—will be incremented; and the re-settable running count—of the total of the prices of all products which were vended since the last inventory function was performed, and which is stored in the HEX 2007 and HEX 2008 locations in the RAM—will be incremented.

Step 364 is entitled INCREMENT SELECTION TOTALS and it corresponds to lines 3090 through 3720 of the program; and, during that step, the data in register 3 will be used to address the locations in the RAM where the data corresponding to the selection line numbers are located. At such time, the re-settable and the non-re-settable running counts —of the number of products vended in response to the actuation of the currently-addressed selection line—will be incremented by one (1). Also during step 364, the MAXIT register will be set. Step 366 is entitled ADD NICKELS TO SELECTION TOTAL and it corresponds to lines 3730 through 3810 of the program. During that step, the count which represents the dollar value—in five cents (5¢) units—of the product that was just vended by the vending machine will be added to the non-re-settable running count of that same product, and also will be added to the re-settable count of that product. Thereafter, the program will branch, via MODE connective 368—which corresponds to line 3860 of the program—to connective 328 of FIG. 3 to initiate further routines of FIG. 4 until further pulses are noted on conductor 92.

Figure 11:
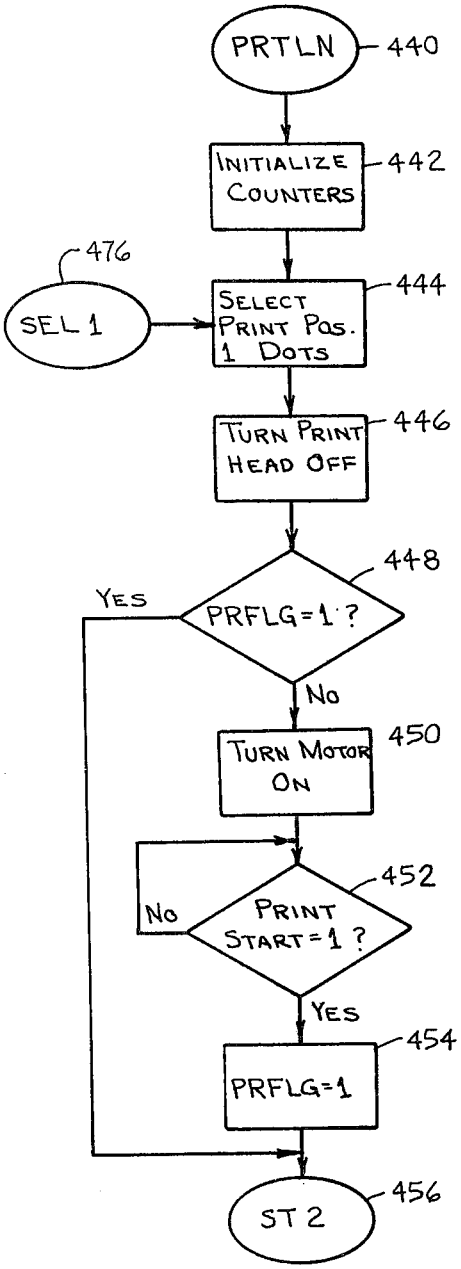
Figure 12:
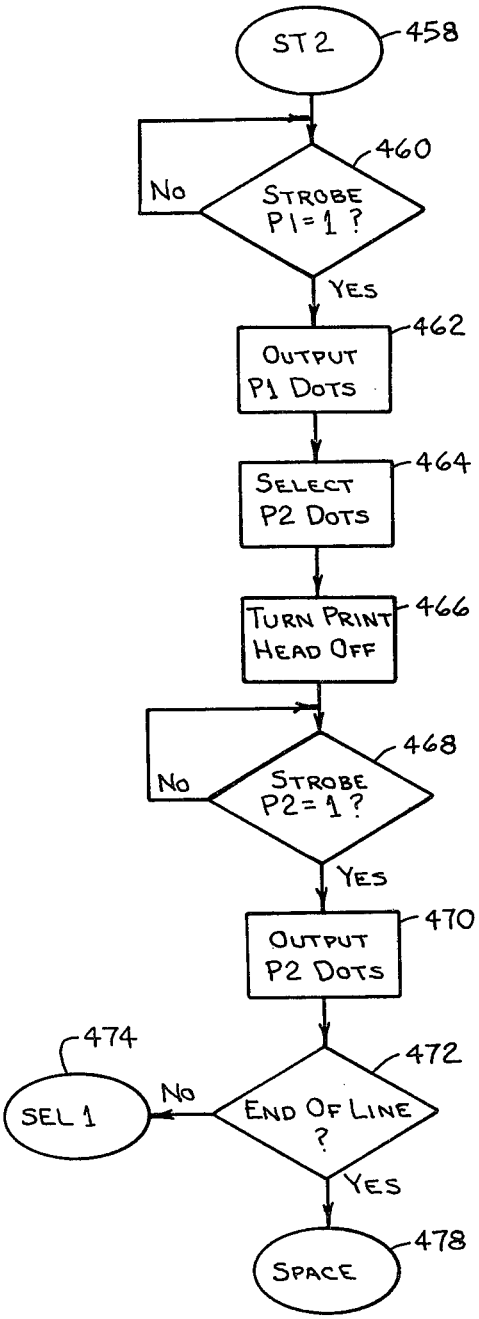
Figure 13:
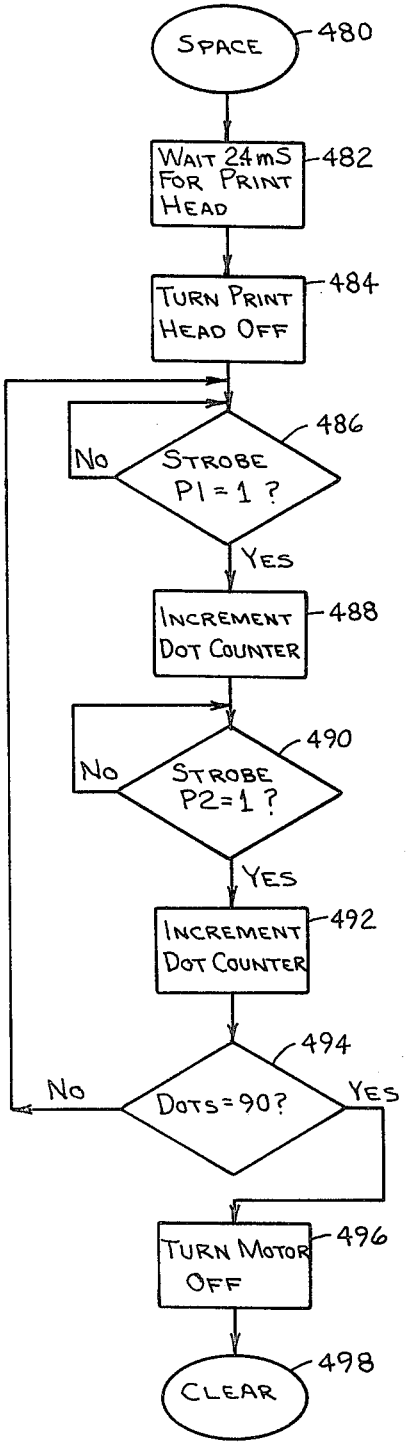

When, during a looping of the program through the routine of FIG. 4, step 316 determines that switch 138 of FIG. 1 has been closed, a YES will be provided by that step; and step 370 will then be executed. That step is entitled VEND ENABLE RELAY OFF and it corresponds to lines 1330 through 1340 of the program; and, during that step, pin 6 of Port 5 of microprocessor 62 will change its state so relay coil 80 will become de-energized and movable contact 90 will shift away from fixed contact 84. Thereupon, the coin changer 51 will become incapable of accepting further coinage until the state of that pin is changed back to its "relay enable" state. The program will then branch—via DUMP connective 372 which corresponds to line 1350 of the program and correspondingly-identified connective 374 of FIG. 7—to a subroutine 376 of FIG. 7 which is entitled CALL CLEAR and which corresponds to line 4590 of the program. During that sub-routine—which is shown in detail by FIG. 14—the print buffer will be cleared by setting the ASCII character for blank space therein. Twenty (20) scratch pad registers, namely, 16 through 35, store the data which constitutes the print buffer; and the ASCII character for blank space is HEX 20. The number 378 in FIG. 7 denotes a sub-routine which is entitled CALL PRTLN and which corresponds to line 4650 of the program; and that sub-routine is shown in detail by FIGS. 11–13. During that sub-routine, whatever data is in the print buffer will be printed by the printer 136—all as shown by the steps of FIGS. 11 through 13.

Figure 7:
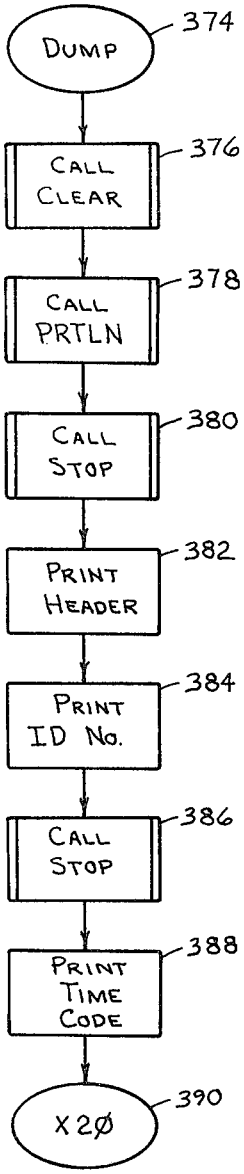
Figure 10:
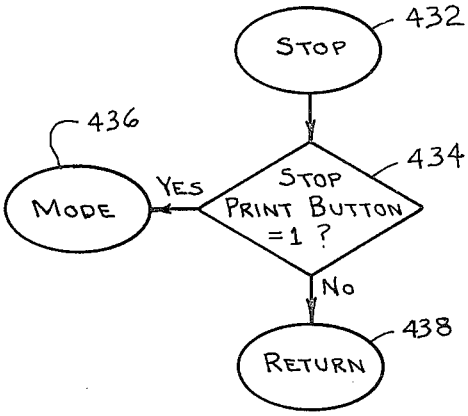

Step 380 of FIG. 7 is a sub-routine entitled CALL STOP and it corresponds to line 4660 of the program; and the step of that sub-routine is shown by FIG. 10. During step 434 of FIG. 10—which corresponds to step 380 of FIG. 7, which is entitled STOP PRINT BUTTON=1?, and which corresponds to lines 8670 through 8690 of the program—the state of switch 140 of FIG. 1 will be checked. If that switch is closed, the program will jump, via MODE connective 436 of FIG. 10 to connective 328 of FIG. 3; and then will loop through step 310 and the routine of FIG. 4 until either a further series of pulses is noted on conductor 92 or the print switch 138 of FIG. 1 is closed. Step 310 of FIG. 3 will be executed immediately upon the re-entry of the program at connective 328—with consequent re-energization of relay coil 80—so the coin changer can again accept coins and thereby resume its normal operation.

Step 382 of FIG. 7 is entitled PRINT HEADER and it corresponds to lines 4700 through 5000 of the program. During that step, the print buffer will be loaded with data corresponding to the first line of the heading of the printout; and then the sub-routine of FIGS. 11 through 13 will be called to effect the printing of the data in the print buffer. A representative printout is shown hereinafter:

**********
NATIONAL REJECTORS
DATA ACQUISITION
SYSTEM

| | | | |
|---|---|---|---|
| ID# | | 51156 | |
| TH | | 00000 | |
| TNR | $ | 0004.25 | |
| TR | $ | 0004.00 | |
| P1 | | 000 | |
| S# | IR | INR | $NR |
| 01 | 003 | 00003 | 0003. 00 |
| 02 | 000 | 00000 | 0000. 00 |
| 03 | 000 | 00000 | 0000. 00 |
| 04 | 000 | 00000 | 0000. 00 |
| 05 | 000 | 00000 | 0000. 00 |
| 06 | 000 | 00000 | 0000. 00 |
| 07 | 000 | 00000 | 0000. 00 |
| 08 | 000 | 00000 | 0000. 00 |
| 09 | 000 | 00000 | 0000. 00 |
| 10 | 000 | 00000 | 0000. 00 |
| 11 | 000 | 00000 | 0000. 00 |
| 12 | 000 | 00000 | 0000. 00 |
| 13 | 004 | 00005 | 0001. 25 |

At the conclusion of the sub-routine of FIGS. 11 through 13, the print buffer will automatically be loaded with HEX 20 ASCII characters which call for blank spaces. The sub-routine of FIGS. 11–13 and the subsequent loading of the print buffer with HEX 20 ASCII characters will occur as often as required to print the heading of the print out. In one preferred embodiment of the present invention that heading consists of six (6) lines; and the last execution of the sub-routine of FIGS. 11–13, which is needed to effect the printing of the heading, will load the HEX 20 ASCII characters into the print buffer.

The numeral 384 in FIG. 7 denotes a step which is entitled PRINT ID NO and which corresponds to lines 5040 through 5560 of the program. During that step, the states of the eight position DIP switches 110 and 112 of FIG. 1 will be read to load the print buffer; and then the sub-routine of FIGS. 11–13 will be called to print a line corresponding to the data in that buffer.

The numeral 386 denotes a further CALL STOP sub-routine, and it corresponds to line 5600 of the program. During that sub-routine, the state of switch 140 in FIG. 1 will again be checked by step 434 of FIG. 10—all as described hereinbefore in connection with step 380.

The numeral 388 of FIG. 7 denotes a step which is entitled PRINT TIME CODE and which corresponds to lines 5640 through 5820 of the program. During that step, the time data which is stored in RAM locations HEX 2002 and HEX 2003 will be loaded into the print buffer, and then the sub-routine of FIGS. 11–13 will execute the printing of that line.

Figure 8:
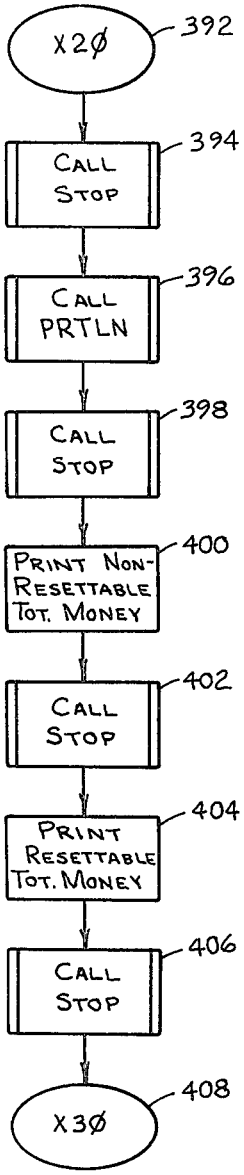

The numeral 390 of FIG. 7 denotes an X20 connective; and it will cause the program to branch, via a similarly-identified connective 392 of FIG. 8, to a further CALL STOP sub-routine 394 which corresponds to line 5860 of the program. That sub-routine will be identical in function and operation to the CALL STOP sub-routine of steps 380 and 386. Step 396 denotes a further CALL PRTLN sub-routine which corresponds to line 5890 of the program; and that sub-routine will be identical to the sub-routine 378 of FIG. 7. The numeral 398 of FIG. 8 denotes a further CALL STOP sub-routine which corresponds to line 5930 of the program; and that sub-routine will be identical to the sub-routines 380, 386 and 394.

The numeral 400 denotes a step which is entitled PRINT NON-RESETTABLE TOTAL MONEY and which corresponds to lines 5980 through 6230 of the program. During that step, the data in RAM locations HEX 2004 and HEX 2005 will be read, will be converted from numeric counts to dollar and cents values, will be converted into ASCII representations, will be loaded into the print buffer, and then will be printed by the sub-routine of FIGS. 11–13. At the conclusion of that sub-routine the print buffer will again be loaded with HEX 20 ASCII characters. The numeral 402 of FIG. 8 denotes a further CALL STOP sub-routine which corresponds to line 6270 of the program; and that sub-routine will be identical to similarly-numbered sub-routines 380, 386, 394 and 398.

The numeral 404 denotes a step which is entitled PRINT RESETTABLE TOTAL MONEY and which corresponds to lines 6310 through 6540 of the program. During that step, the data in RAM locations HEX 2006 and 2007 will be read, will be converted from numeric counts to dollars and cents values, will be converted into ASCII representations, will be loaded into the print buffer, and then will be printed by the sub-routine of FIGS. 11–13. At the conclusion of that sub-routine, the print buffer will again be loaded with HEX 20 ASCII characters. The numeral 406 denotes another CALL STOP sub-routine and it corresponds to line 6580 of the program. That sub-routine will be identical to the CALL STOP sub-routines 380, 386, 394, 398 and 402.

Figure 9:
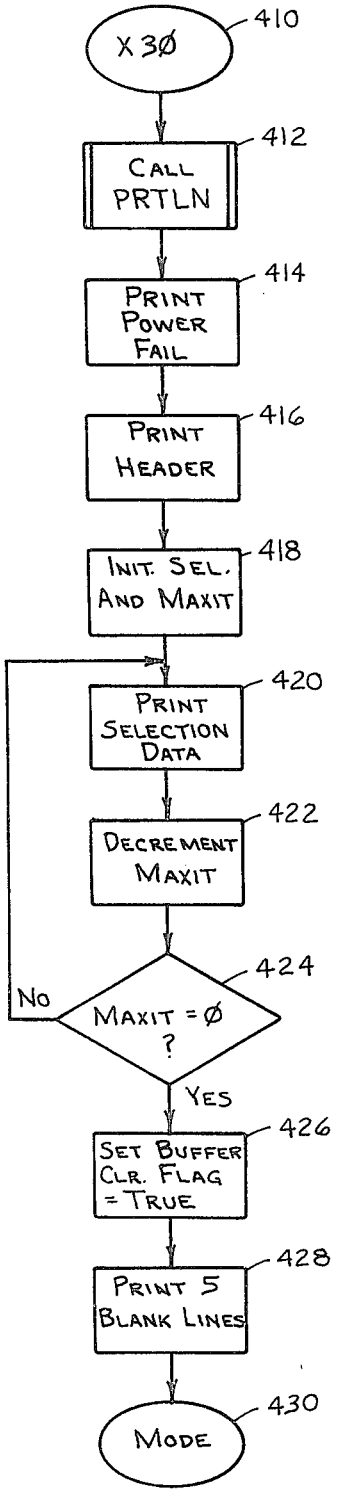

The numeral 408 denotes an X30 connective which causes the program to branch, via identically-identified connective 410 of FIG. 9, to another CALL PRTLN sub-routine 412 that corresponds to line 6600 of the program. That sub-routine will be the same as the sub-routines 378 and 396. The numeral 414 denotes a step which is entitled PRINT POWER FAIL and which corresponds to lines 6640 through 6890 of the program. During that step, the data in RAM location HEX 200A will be read, will be converted to its ASCII representation, will be loaded into the print buffer, and then will be printed by the sub-routine of FIGS. 11–13. At the conclusion of that sub-routine the print buffer will again be loaded with HEX 20 ASCII characters.

The numeral 416 denotes a step which is entitled PRINT HEADER and which corresponds to lines 6940 through 7320 of the program. During that step, the program will load into the print buffer, in ASCII representation form, the various letters and symbols constituting the header, will execute the sub-routine of FIGS. 11–13 to print that header, and then will load HEX 20 ASCII characters into that print buffer. The numeral 418 denotes a step which is entitled INIT SEL AND MAXIT and which corresponds to lines 7380 through 7470 of the program.

It will be noted that each time the RAM locations are cleared of re-settable totals, the MAXIT location in the RAM will be set to zero (0). The next time the conductor 92 receives a serial bit stream, the selection line number which is represented by that serial bit stream will be determined and will be stored in the MAXIT location. During each succeeding time the conductor 92 receives a serial bit stream, the selection line number represented by that serial bit stream will be determined and will be stored in the MAXIT location—if it is higher than the previously-stored selection line number. If the selection line number represented by that serial bit stream equals or is smaller than the selection line number which is stored in the MAXIT register, the stored number will be left unchanged. In this way, the number which is stored in that register will quickly be incremented until it equals the total number of active selection switches of the vending machine.

Whenever a command to print is developed—as in the routine of FIGS. 11–13—the program will read the number in the MAXIT location and store it in scratch pad register 38. Also, the data in scratch pad register 39, which corresponds to the selection line number, will be set to zero (0). Thereafter, the program will cause the printer 136 to print on the printout only that number of horizontal rows of selection line data which equals the number that is stored in the MAXIT location—and which represents the highest-numbered active selection switch of the vending machine. This is very desirable; because it will enable the printer 136 to stop printing lines on the printout when it reaches the highest-numbered selection line for which any data has been sensed and stored since the last time an inventory function was performed. As a result, the printing operation will be kept as short as practical. Also the printout will not have a long blank area at the end thereof which would correspond to that portion of the thirty-two (32) selection line capacity of the data acquisition unit which was not used by the vending machine.

Step 420 of FIG. 9 is entitled PRINT SELECTION DATA and it corresponds to lines 7500 through 8920 of the program. That step will cause the sub-routine of FIGS. 11–13 to be executed; and, during that sub-routine, the data—which relates to selection line one and which is to be printed on the printout as a data line—will be converted to dot form, will be given ASCII representation, will be loaded into the print buffer, and then be printed onto the printout. That data consists of the selection line number, the number of products vended during vending operations (other than "free vends") initiated by the first selection switch since the last inventory function, the total number of products vended during vending operations (other than "free vends") initiated by the first selection, and the total of the prices of all products vended during vending operations (other than "free vends") initiated by the first selection switch.

The numeral 422 denotes a step which is entitled DECREMENT MAXIT and which corresponds to line 8300 of the program. During that step, the number in scratch pad register 38 will be decremented by one (1). The numeral 424 denotes a step which is entitled MAXIT=0? and which corresponds to line 8310 of the program; and the comparing function of that step will determine whether the number in scratch pad register 38 is zero (0). If a NO is produced by that function, the program will loop to step 420 where the data in the next higher selection number will be read from the RAM location, will be converted to ASCII representation, will be loaded into the print buffer, and then will be printed by the sub-routine of FIGS. 11–13. At the conclusion of that sub-routine, the print buffer will again be loaded with HEX 20 ASCII characters. Also, the data in scratch pad register 39 will be incremented, so the next execution of step 420 will address a still-higher numbered selection line. During the succeeding execution of step 422, the number in scratch pad register 38 will again be decremented; and, during the succeeding execution of step 424, a further comparing function will determine whether the data in scratch pad register 38 is zero (0). If a further NO is provided, the program will loop through steps 420, 422 and 424—with successive reading of the data corresponding to progressively-higher selection numbers, with conversions of that data to ASCII representation, and with printing of that data until the number in scratch pad register 38 is zero (0). At the conclusion of those loopings, the printer will respond to the resulting YES from step 424 to cause the program to execute step 426—which is entitled SET BUFFER CLEAR FLAG=TRUE and which corresponds to lines 8360 through 8380 of the program. During that step, the buffer clear flag will be set to "true" from its previously-set "false" state. Step 428 is entitled PRINT 5 BLANK LINES and it corresponds to lines 8440 through 8480 of the program. During that step, the PRTLN sub-routine of FIGS. 11–13 will be called and executed five (5) times. Because the print buffer will be loaded with HEX20 ASCII characters before each of those five (5) executions, and because it will be loaded with HEX 20 ASCII characters at the ends of those executions, five (5) blank lines will be provided on the printout during the advancing of that printout. The numeral 430 denotes a MODE connective which will branch the program, via connective 328 of FIG. 3 to step 310 and then to the routine of FIG. 4. Step 310 will again re-energize the relay coil 80 and thereby close the contacts 84 and 90 to apply a Line 6 signal to the coin changer 51.

If a further printout is desired, it is only necessary to re-close the switch 138 of FIG. 1. Thereupon, the hereinbefore-described routine of FIGS. 7–9 will be repeated to produce an exactly-identical printout; because none of the data of that printout has been cleared. By merely pressing the switch 138 of FIG. 1 as often as desired, any number of identical printouts can be attained—as long as no "non-free" vending operations have occurred. If any succeeding execution of step 316 of FIG. 4 provides a NO, the program will loop through the routine of FIG. 4 and step 310 of FIG. 3 until some further action is taken which will affect one or more of the steps through which the program will loop.

Figure 6:
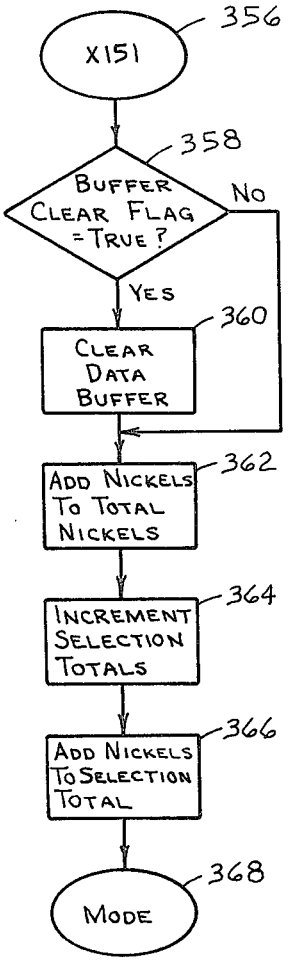

During each execution of step 324 of FIG. 4 wherein a YES is provided, the program will branch to, and execute, the routine of FIGS. 5 and 6. During step 358 of FIG. 6, a YES will be provided; because the buffer clear flag was set to "true" during step 426 of FIG. 9. Thereafter, the rest of the routine of FIG. 6 will be executed before the program branches, via connectives 368 and 328, respectively, of FIGS. 6 and 3, to step 310 of FIG. 3—with consequent looping through that step and the routine of FIG. 4.

As pointed out hereinbefore, step 434 of FIG. 10 constitutes the CALL STOP sub-routine of steps 380, 386, 394, 398, 402 and 406. STOP connective 432 will direct the program to that step; and MODE connective 436 will repeatedly branch the program back to step 310 of FIG. 3 until a NO is produced by the comparing function of step 434—thereby indicating that switch 140 of FIG. 1 has been closed. When that NO is produced, RETURN connective 438 of FIG. 10, which corresponds to line 8700 of the program, will cause that program to reenter that CALL STOP step which directed the program to the sub-routine of FIG. 10.

It will be noted that the printing unit of the Olivetti Model PU1800/B/18 thermal printer can print only ten (10) dots at a time; and, in the preferred format of data on the printout, each horizontal row has one hundred (100) dot-accepting locations. The print of data in that number of dot-accepting locations is effected by (a) printing whatever dots are needed in the endmost odd-numbered ten (10) dot-accepting locations of the uppermost row of dots in a line of data during a first execution of step 462 of FIG. 12, (b) printing whatever dots are needed in the ten (10) even-numbered dot-accepting locations immediately adjacent the previously-printed odd-numbered dots during a first execution of step 470 of FIG. 12, and (c) alternating four additional executions of step 462 with four additional executions of step 470. The resulting ten (10) printings will provide all of the dots which are needed in the uppermost row of dots in a line of data on the printout.

It also will be noted that the printing unit prints the uppermost row of dots of any data line by advancing in step-by-step fashion from right to left; and, further, that the printing unit will print the next-uppermost row of that data line by advancing in step-by-step fashion from left to right. As a result, the endmost odd-numbered dots will be adjacent the right-hand ends of some rows but will be adjacent the left-hand ends of other rows. However, in the printing of each row of dots, the printing unit will start at the leading edge of that row.

The paper, which will be used as part of the printout, is continually in engagement with the printing unit. Also that paper will move continuously relative to that printing unit. However, the movement of that paper relative to the thermal heads of that printing unit is slow enough, and those thermal heads heat and cool rapidly enough, so dots can be formed in a discrete and clear manner.

The microprocessor 50 has two EPROMS wherein the attached program is stored; and the locations wherein that program are stored are followed by locations where a dot pattern look-up table is stored. The data which is to be printed on the printout must be read, must be converted into a dot pattern by use of the dot pattern look-up table, and then must be stored in the print buffer. Thus, as indicated by FIGS. 11–13, registers 2 and 6 must be initialized to zero (0) in step 442, which is entitled INITIALIZE COUNTERS and which corresponds to lines 11560 through 11660 of the program. During step 444—which is entitled SELECT PRINT POS. 1 DOTS and which corresponds to lines 1700 through 1214 of the program—the data, which relates to a selection line and which is to be printed on the printout as a data line, will be read, and then the dot pattern look-up table will provide corresponding dot pattern data. That data will be loaded into scratch pad registers 4 and 5, and thereafter will be transferred to Ports 0 and 1 of microprocessor 50. The thermal heads of the printing unit will be turned "off" in step 446, which is entitled TURN PRINT HEAD OFF and which corresponds to lines 12180 through 12200 of the program. Those heads are turned "off" by causing the pins 0 through 7 of Port 0 and the pins 0 and 1 of Port 1 to apply "0"s to the inputs of inverter drivers 54, 56, 58, 60, 63, 64, 66, 68, 70 and 72, respectively. The resulting logic "1"s at the outputs of those inverter drivers wil de-energize all of the thermal heads.

During step 448, a comparing function will determine whether a bit has been set in register 6 to indicate that a printing step has been initiated. Because that register was initialized to zero (0) during step 442, the comparing function of step 448 will provide a NO. Thereupon, step 450 will cause pin 7 of Port 5 of FIG. 2 to apply a "1" to the input of inverter driver 74; and the consequent "0" at the input of Darlington amplifier 192 will cause a logic "1" to be applied to conductor 210 to start the motor of printer 136. Also, a "0" at the input of Darlington amplifier 170 will cause an enabling "1" to be applied to the thermal heads of the printing unit of printer 136. However, the signals at pins 0 through 7 of Port 0 and pins 1 and 2 of Port 1 will be keeping those thermal heads de-energized. During step 452 which is entitled PRINT START = 1? and which corresponds to lines 12320 through 12346 of the program, a comparing function will determine whether the printer has applied a "start" to conductor 146. If that function provides a NO, the program will loop at step 452 until that strobe is applied to that conductor. As soon as step 452 senses the application of that strobe, it will provide a YES; and then step 454—which is entitled PRFLG = 1 and which corresponds to lines 12350 through 12360 of the program—will set a bit in register 6 to indicate that a printing operation has been initiated. Thereafter the program will branch, via ST2 connectives 456 and 458, respectively, of FIGS. 11 and 12 to step 460, which is entitled STROBE P1 = 1? and which corresponds to lines 12380 through 12400. If the printer has applied strobe P1 to conductor 148—to indicate that the printing unit has moved into position to print the endmost odd-numbered dots of the uppermost row of a line of data, the comparing function of step 460 will provide a YES. If a NO is provided, the program will loop at step 460 until the P1 strobe is developed.

During step 462—which is entitled OUTPUT P1 DOTS and which corresponds to lines 12420 through 12780—pins 0 through 7 of Port 0 and pins 1 and 2 of Port 1 will apply logic states to the inputs of the adjacent inverter drivers to cause energizing "0"s to appear at the inputs of those thermal heads which are intended to form dots during the printing step. While step 462 is being executed, step 464 will be initiated; because step 462 takes a finite time to execute. Step 464 is entitled SELECT P2 DOTS and it corresponds to lines 12830 through 13270 of the program. During that step, the dot pattern for the topmost even-numbered dots which are immediately adjacent the just-printed endmost odd-numbered dots will be determined from the dot pattern look-up table; and then the resulting data will be stored in scratch pad registers 4 and 5 and subsequently applied to the Ports 0 and 1 of microprocessor 50. At the conclusion of the printing operation of step 462, the data in dot register 2 will be incremented by a one (1). Also, step 466—which is entitled TURN PRINT HEAD OFF and which corresponds to lines 13310 through 13330 of the program—will de-energize all of the thermal heads—in the same manner in which those thermal heads were de-energized during step 446 of FIG. 11.

During step 468—which is entitled STROBE P2=1? and which corresponds to lines 13350 through 13370 of the program—a comparing function will determine whether the P2 strobe has been applied to conductor 152. That strobe will be applied when the printing unit is in position to print the endmost even-numbered dots. If the comparing function of step 468 provides a NO, the program will loop at that step until the P2 strobe is applied. Thereupon, step 470—which is entitled OUTPUT P2 DOTS and which corresponds to lines 13390 through 13780 of the program—will be executed. During that step appropriate signals will be applied to the pins of Ports 0 and 1 of microprocessor 50 to effect the heating and de-energization of appropriate ones of the thermal heads; and thereby effect the printing of the endmost, even-numbered dots in the topmost row of the line of data. Before the conclusion of step 470, the number in the dot register 2 will be incremented. Step 472 which is entitled END OF LINE? and which corresponds to lines 13820 through 13860 of the program, will determine whether an entire line of data has been printed on the printout. Specifically, the two (2) in dot register 2—which represents a single execution of each of steps 462 and 470—will be compared with the number seventy (70), and will provide a NO. Thereupon, the program will branch, via SEL1 connective 474 of FIG. 12 and the identically-identified connective 476 of FIG. 11, to step 444 of FIG. 12. During that step the dot pattern look-up table will be read to determine the dot pattern for the data for the next odd-numbered dot-accepting locations, and then, during step 446, the printing elements will again be turned "off". During step 448, the comparing function will provide a YES; and hence the program will branch to ST2 connective 456—and thence via ST2 connective 458 of FIG. 12 to step 460. During step 472 of FIG. 12 the print motor will be turned off as a result, and during step 450 of FIG. 11, the motor will be turned on, to start the next line of printing.

The program will execute step 460 and the rest of the routine of FIG. 12; and, in doing so, will print two further groups of dots for the uppermost row of the line of data, and also will increment dot register 2 twice. Consequently, the comparing function of step 472 will provide a further NO, and a further looping of the program to step 444 of FIG. 11. The printer 136 will require a total of five (5) executions of the routine of FIGS. 11 and 12 to provide five (5) printings of odd-numbered dots. However, when the fifth execution of those routines is complete, the count in dot register 2 will be ten (10) and the printing unit will have automatically indexed itself into register with the second uppermost row of dots.

The ten (10) printing operations for the uppermost row of dots will be followed by ten (10) further printing operations to print the second uppermost row. Because each of the characters that are used in printing the printout consists of seven (7) vertically-spaced horizontal rows, the printing of one full line of data requires a total of thirty-five (35) loopings through the routine of FIGS. 11 and 12. During each looping, the number stored in dot register 2 will be incremented twice; and hence, at the end of the thirty-five loopings, step 472 will determine that the count in that register equals the seventy (70) which was loaded into that register during step 302. Thereupon, the program will respond to the YES of step 472 to branch, via SPACE connective 478 and identically-named connective 480 of FIG. 13 to step 482, which is entitled WAIT 2.4 MS FOR PRINT HEAD and which corresponds to lines 13900 through 13950 of the program.

During that step, any further movement of the program will be delayed for a time period which corresponds to the normal delay that is involved in selecting the dot pattern for a next group of dots. During step 484, which is entitled TURN PRINT HEAD OFF and which corresponds to lines 13970 through 13990 of the program, the same operation is performed that was performed in steps 446 and 466, namely, the de-energizing of the thermal heads of the printing unit. Step 486, which is entitled STROBE P1=1? and which corresponds to lines 14010 through 14030, will determine whether the P1 strobe is being applied to conductor 148 by printer 136. If the answer is NO, the program will loop at step 486 until that strobe is applied. When that strobe is applied, step 488—which is entitled INCREMENT DOT COUNTER and which corresponds to lines 14070 through 14090—will be indicated. During that step, the data in dot register 2 will be incremented to seventy-one (71). During step 490—which is entitled STROBE P2=1? and which corresponds to lines 14130 through 14150 of the program—will determine whether printer 136 is applying the P2 strobe on conductor 150. If the answer is NO, the program will loop at step 490 until that strobe is applied. Step 492—which is entitled INCREMENT DOT COUNTER and which corresponds to lines 14190 through 14210 of the program—will increment the count in dot register 2 to seventy-two (72). During step 494—which is entitled DOTS 90? and which corresponds to lines 14230 through 14240 of the program—the count in dot register 2 will be checked to determine whether it equals ninety (90). If the answer is NO, the program will loop through steps 486, 488, 490, 492 and 494 until the answer is YES. During the twenty (20) increments of the count in dot register 2—after the conclusion of step 472 of FIG. 12, the printing head will move vertically downwardly a distance equal to the combined heights of two rows of dots. The thermal heads were left de-energized, and hence a blank space was created between the previously-printed line of data and the next-succeeding line of data. Step 496 is entitled TURN MOTOR OFF and it corresponds to lines 14280 through 14290 of the program; and, during that step, the state of pin 7 of Port 5 will be changed to render the Darlington amplifiers 170 and 192 conductive. Thereupon, the motor will be de-energized, and hence will permit the printing unit to come to rest.

Figure 14:
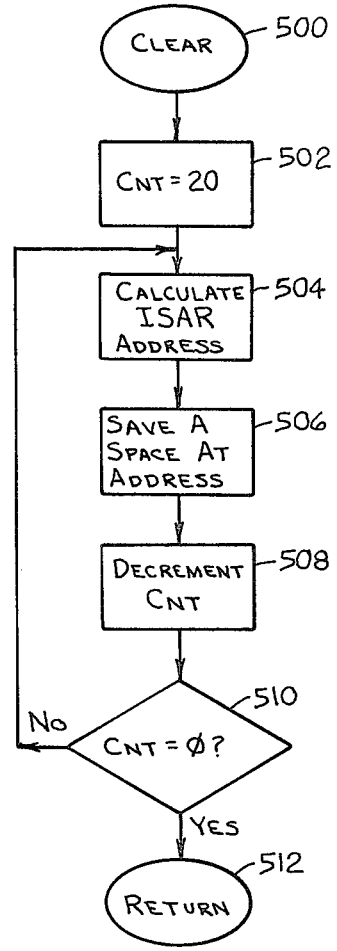

The program will then branch, via CLEAR connective 498 and identically-named connective 500 of FIG. 14, to step 502, which is entitled CNT=20 and which corresponds to lines 14330 through 14340 of the program. During that step, the dot register 0 will have data loaded into it which corresponds to the number twenty (20). The numeral 504 denotes a step entitled CALCULATE ISAR ADDRESS and which corresponds to lines 14350 through 14370 of the program. During that step, the base address of fifteen (15) is added to the count of twenty (20)—which was established in register 0 during step 502—to provide the count of thirty-five (35). That count will enable the ISAR to address register 35 which is the highest-number register of the print buffer. The numeral 506 denotes a step which is entitled SAVE A SPACE AT ADDRESS and which corresponds to lines 14380 through 14390 of the program. During that step, the ASCII representation HEX 20—which corresponds to a blank space—will be loaded into the ISAR. Step 508 is entitled DECREMENT CNT, and it corresponds to line 14400 of the program; and, during that step, the count in register 0 will be decremented by one (1). During step 510, which is entitled CNT=0? and which corresponds to line 14410 of the program, a comparing function will determine whether the count in register 0 has been decremented to zero (0). If the answer provided by that function is NO, the program will loop through steps 504, 506, 508 and 510 until that function provides a YES. At that time, the ISAR will address the first register which is part of the print buffer; and that register will have been loaded with space-indicating HEX 20's. The program will then, via connective 512—which is entitled RETURN and which corresponds to line 14420 of the program—cause the program to return to the particular step which initiated the sub-routine of FIGS. 11–13.

During the sub-routine of FIG. 7, the execution of step 378 will branch the program to the sub-routine of FIGS. 11–13. Similarly, during executions of the routines of FIGS. 8 and 9, the executions of steps 396 and 412 will branch the program to the sub-routine of FIGS. 11–13. However, because HEX 20 is loaded into the print buffer at the end of each printing operation, and because the PRTLN sub-routines will not load any data into that buffer, that buffer will not have any data in which it could effect the printing of data on the print-out. Consequently, although the various steps of the routine of FIGS. 11–13 would be executed, and although the routine of FIG. 14 would be executed; all of the thermal heads of the printing unit would remain de-energized. Consequently, each execution of a PRTLN sub-routine will provide a full seven row high blank space on the face of the print-out.

The operation of the sub-routine of FIGS. 11–13 is longer when it is initiated by step 420 than it is when it is initiated by any of steps 378, 382, 384, 388, 396, 400, 404, 412, 414, 416 and 428; because step 420 requires a full line of data for each selection line. However, the execution of the sub-routine of FIGS. 11–13 for steps 382, 384, 388, 400, 404, 414 and 416 will, except for the shorter time required, be essentially the same as that described hereinbefore in connection with step 420. In the case of steps 378, 396, 412 and 428, the execution of the sub-routine of FIGS. 11–13 is different from that of step 420. Specifically, steps 378, 396, 412 and 428 do not supply power to the thermal heads of the printer 136; and hence the execution of the sub-routine of FIGS. 11–13 will, during those steps, provide blank spaces on the printout.

It will be noted that the relay coil 80 must be energized to maintain the contacts 90 and 84 in engagement. Further, it will be noted that unless those contacts are maintained in engagement, the vending machine 51 will be unable to accept coins. This is significant; because it will keep persons from removing the line cord of the data acquisition unit from the socket therefor in an effort to decrease the number of vends which would be recorded on the next printout. Further, any separation of the plug and socket 33 from each other also would keep the coin changer 51 from accepting coins. The combination of relay coil 80 and the running count of power outages will minimize the likelihood of "cheating" by manipulation of line cores, sockets, fuses or the like.

It will be noted that the price data which is supplied to the printer 136 is the exact data that is generated by the vending machine during vending operations. When changes are made in the prices that are set in the vending machine, the data which is supplied to the data acquisition unit and the data which that data acquisition unit will supply to the printer, will automatically and fully reflect those changes.

It will be noted that the sub-routine of FIG. 14 is automatically addressed by the program at the end of the sub-routine of FIGS. 11–13. However, the former sub-routine also can be addressed directly by step 376 of FIG. 7. At the conclusion of the sub-routine of FIG. 14, the program will return to the particular step which called it; and, in the case where that sub-routine immediately follows the subroutine of FIGS. 11–13, it will return to the step which called the sub-routine of FIGS. 11–13.

A considerable number of the steps of the flow chart are dedicated to the operation of the Olivetti printer. Because that printer is a commercially-available device, and because it always requires a program to enable it to operate, some portions of the program are not, per se, parts of the present invention. Instead, those parts merely illustrate the printing function that is performed by the printer 136. Commercially-available programs are offered to purchasers of the Olivetti printer; but the steps of the attached program are desired, because they are tailored to the printout format disclosed herein.

Figure 15:
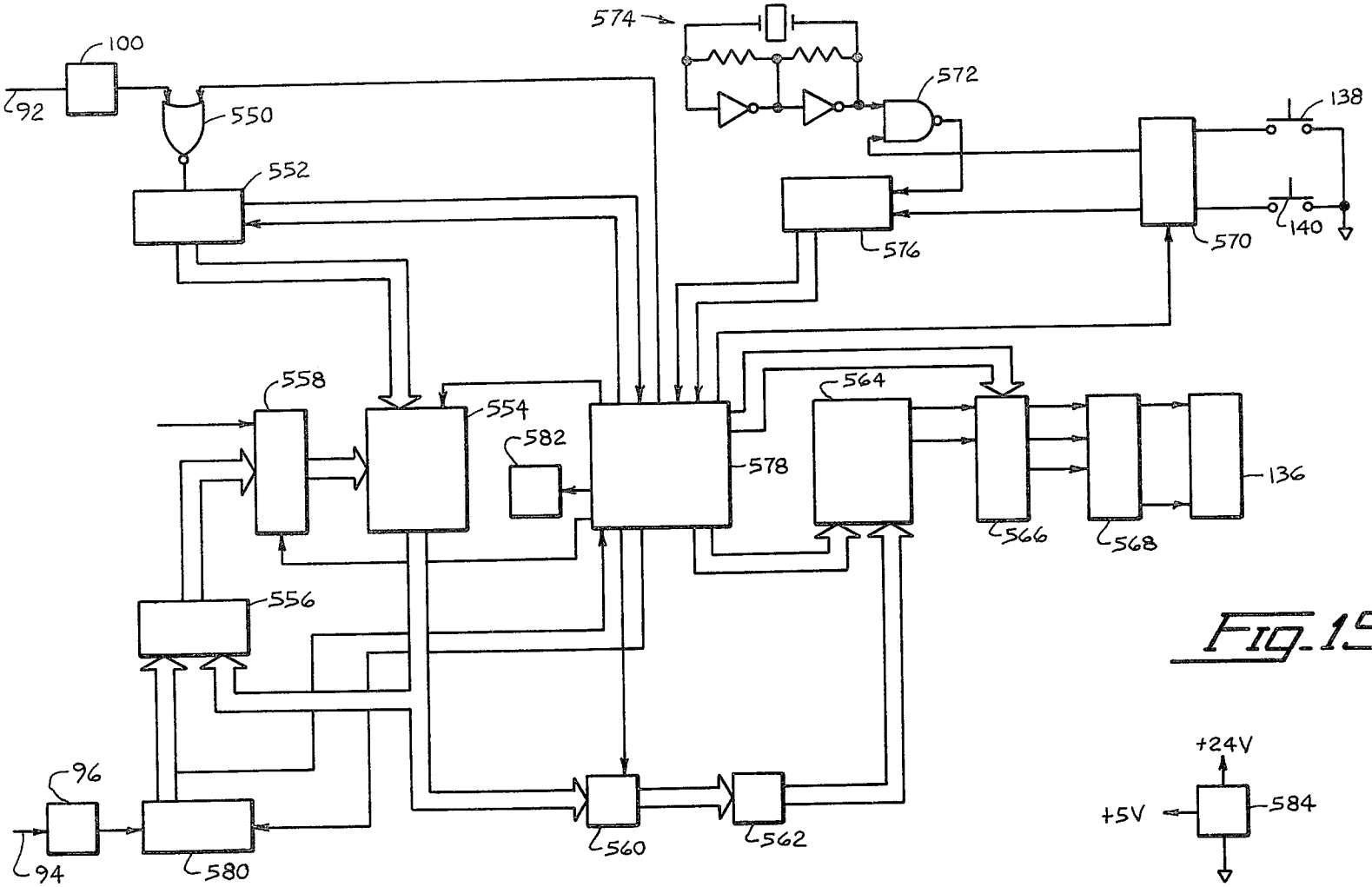
FIG. 15 is a block diagram of a hardware version of that data acquisition unit.

Referring particularly to FIG. 15, the numeral 550 denotes a NOR gate which has the output of opto-coupler 100 of FIG. 1 connected to one input thereof. The output of that NOR gate is connected to a binary counter 552 which preferably consists of four 7497 binary counters. The output of that counter is connected to the address lines of a data RAM 554 which preferably consists of four 5101 CMOS RAMS. The output of that RAM is connected to the B inputs of an adder 556 which preferably is eight 7483 adders. The output of that adder is connected, via a latch 558, to the Data In inputs of RAM 554. That latch preferably is two 74LS273 octal latches. The data outputs of that RAM also are connected to a Binary-BCD converter 560 which preferably will be four 74185 Binary-BCD converters. The output of that converter is connected to a multiplexer 562 which preferably is four 74LS153 multiplexers. The output of that multiplexer is connected to the address inputs of a ASCII pattern look-up PROM 564, which preferably is a 2708 EPROM. A printer controller 566, which preferably is a CY-480 UPC of Cybernetic Micro Systems, will receive data from the PROM 564 and will supply data to a printer interface 568, which preferably will consist of all of the components of FIGS. 1 and 2 that are (a) connected to pins 0 through 7 of Port 0, to pins 0, 1, 6 and 7 of Port 4, and to pins 0–3 and 6 of Port 5 and (b) located to the left of plug and socket 114 in FIGS. 1 and 2. Instead of being connected to those pins, the printer interface will be connected to the printer controller 566. The numeral 136 denotes a printer which preferably is identical to the similarly-numbered printer of FIGS. 1 and 2.

The numerals 138 and 140 denote switches which preferably are identical to the similarly-numbered switches of FIG. 1. The numeral 570 denotes a switch logic block which preferably consists of two 7400 and two 7402 gates; and switches 138 and 140 are connected to inputs of that block. One output of that switch logic block is connected to an input of a NAND gate 572; and an oscillator 574—of standard and usual design which develops a frequency of essentially two kilohertz (2 KHz)—is connected to the other input of that NAND gate. The output of that NAND gate is connected to a control state counter 576 which preferably consists of two 7497 binary counters. The other output of switch logic block 570 is connected to the re-set input of counter 576. The output of that counter is connected to a dual octal ten inputs AND/OR gate array 578; and a MMI PAL 10H8 gate array is preferred. One output of that gate array is connected to switch logic block 570; and two further outputs of that gate array are connected to printer controller 566. Lines corresponding to the three least significant bits extend from the gate array 578 to address inputs of the PROM 564. A further output of that gate array extends to the Binary BCD converter 560; and still another output of that gate array extends to a binary counter 580 which preferably consists of four 7497 binary counters. The clock input of that counter receives inputs from conductor 94 and opto coupler 96—each of which preferably is identical to the similarly-numbered conductor and opto coupler of FIG. 1. The output of counter 580 extends to the A inputs of adder 556; and a line corresponding to the least significant bit extends to gate array 578. A further output of that gate array extends to a relay circuit 582 which preferably includes the diode 52, resistor 78, relay coil 80, flyback diode 82 and relay contacts 8 and 90 of FIG. 1. Yet another output of the gate array 578 extends to the read/write input of data RAM 554. A still further output of that gate array extends to the re-set input of binary counter 552. A carry output of that counter is connected to an input of that gate array. Yet another output of that gate array is connected to the other input of NOR gate 550. Still another output of the gate array extends to the CLEAR input of latch 558; and conductor 31 of FIG. 1 extends to the set input of that latch. The numeral 584 denotes a power supply which is connectable to a source of one hundred and fifteen volts A.C. and which supplies regulated plus five (+5) volts and regulated plus twenty-four (+24) volts.

The circuit of FIG. 15 constitutes a hardware equivalent of the control device disclosed by FIGS. 1 through 14. Because of the low cost, simplicity and flexiblity of the control device of FIGS. 1–14, it is the preferred embodiment of the present invention.

The opto-coupler 100 will respond to a serial bit stream on conductor 92 from the coin changer 51 of FIG. 1 to apply a corresponding serial bit stream to the left-hand input of NOR gate 550; and the output of that NOR gate will be a corresponding, but inverted, serial bit stream that will be supplied to the clocking input of counter 552. That counter will count the number of bits in that serial bit stream and will use that count as the address of the data in the data RAM 554. During the succeeding serial bit stream on conductor 94 from coin changer 51, the opto-coupler 96 will apply a corresponding serial bit stream to binary counter 580. That counter will count the number of bits, and then will supply them to adder 556, while also supplying the least significant bit to the gate array 578. The RAM 554 will supply data to the B inputs of the adder 556; and the gate array 578 will apply appropriate signals to the read-write input of the RAM to enable the data which is outputed by the adder 556—and momentarily stored in the latch 558—to be re-written into the appropriate addresses in that RAM. This provides an accumulation of the total number of bits—each of which represents five cents (5¢)—that were supplied in the serial bit stream on conductor 94. The oscillator 574 constitutes a "clock" for the circuit of FIG. 15; and it will act, through NAND gate 572, to supply signals to the control state counter 576. The output of that counter will enable the gate array 578 to apply signals to the NOR gate 550 to permit the counter 552 to provide further addresses in the data RAM which will then be addressed. This enables the circuit to clear the data and also to output the data via Binary-BCD converter 560 and multiplexer 562 to the ASCII pattern look-up PROM 564. The printer controller 566 will respond to the data from that PROM, and also to signals from the gate array 578, to appropriately cause the printer interface 568 and the printer 136 to print characters in the form of dots on a printout sheet in the manner in which the corresponding printer interface and printer of FIGS. 1 and 2 print such a printout.

Figure 2:
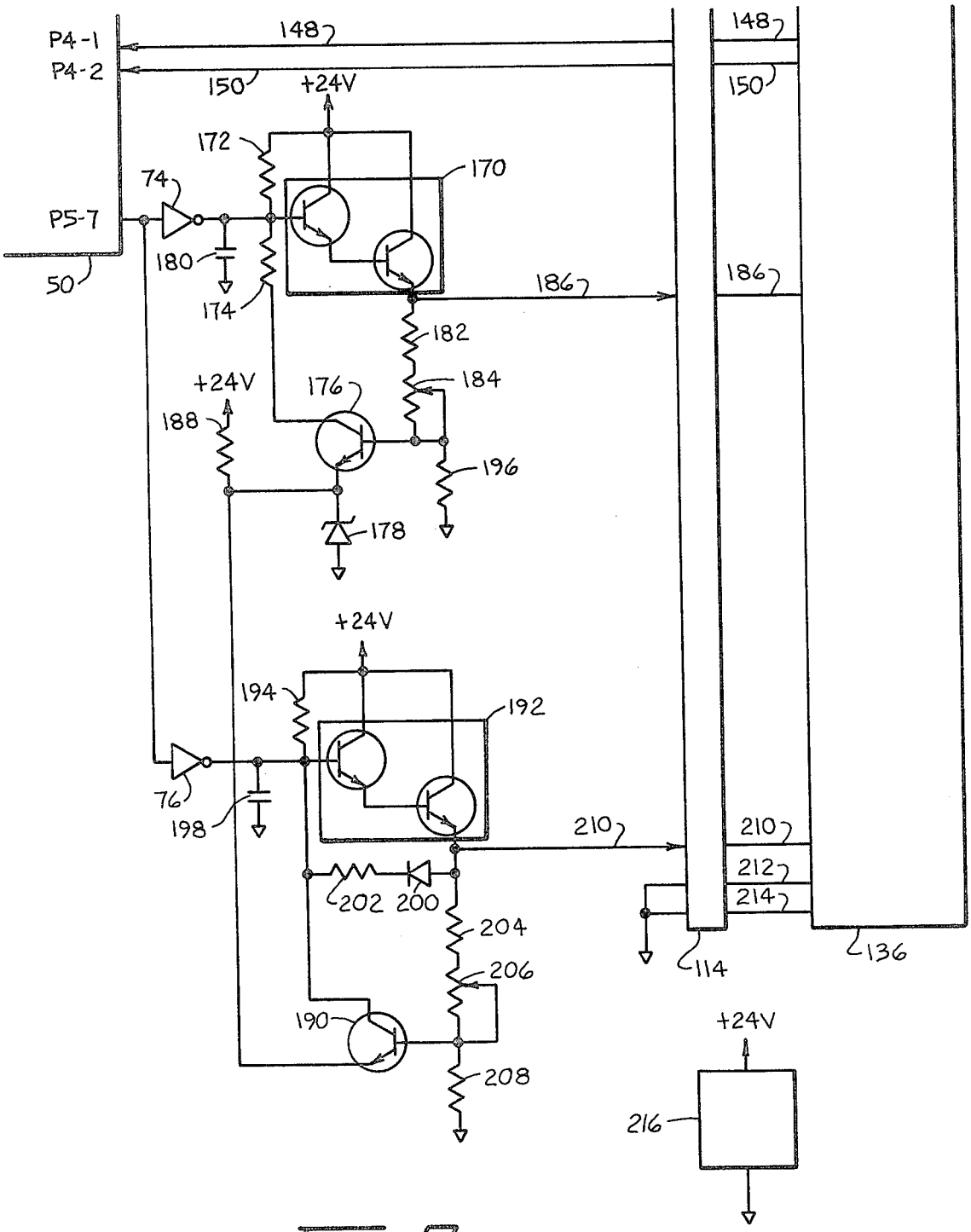

The printer 136 will be started by closing the switch 138 in the manner described hereinbefore in connection with FIGS. 1 and 2. Similarly, the stopping of the printer 136 will be effected by closure of switch 140 in the manner described hereinbefore in connection with FIG. 1. In either event, the closing of a switch will cause switch logic block 570 to apply an appropriate signal to NAND gate 572, and also to the re-set input of control state counter 576. The relay circuit 582 will energize the relay coil 80 and thereby effect the closing of contacts 84 and 90 whenever the printer 136 is not operating and power is on.

Whereas the drawing and accompanying description have shown and described two embodiments of the present invention, it should be apparent to those skilled in the art that various changes may be made in the form of the invention without affecting the scope thereof.

```
F8X V05.1
 TOTALVEND PRINT4 1.0 3/25/79 BRH
  10                 *  TOTALVEND INVENTORY CONTROL SYSTEM
  20                 *
  30                 *  FILE NAME:  PRINT4
  40                        TITLE TOTALVEND PRINT4 1.0 3/25/79 BRH
  50                 *
  60                        PUNCH ON
  70                 *
  80                 * PORT ASSIGNMENTS
  90                 *
 100                 * P0-0 PRINTER THERMAL ELEMENTS
 110                 * TO
 120                 * P0-7
 130                 * TO
 140                 * P1-0,P1-1 THERMAL ELEMENTS
 150                 * P1-6, P1-7 INPUTS DIP SWITCHES
 160                 * P4-0 STRT PRINTER TIMING
 170                 * P4-1 P1 TIMING
 180                 * P4-2 P2 TIMING
 190                 * P4-3 TOT
 200                 * P4-4 SEL
 210                 * P4-5 PRINT SWITCH
 220                 * P4-6 STOP PRINT SWITCH
 230                 * P4-7 ERASE CMOS RAM SWITCH
 240                 * P5-0,1,2,3 OUTPUTS DIP SW.
 250                 * P5-6 RELAY
 260                 * P5-7 PRINTER MOTOR
 270                 *
 280                 *
 290                 *
 300                 *  GLOBAL DECLARATIONS
 310                 *
 320                 CNT      EQU   0              COUNTER FOR CLEAR ROUTINE
 330                 CNT1     EQU   3
 340                 CNT2     EQU   4
 350                 CNT3     EQU   5
 360                 DIR      EQU   0              DIRECTION FLAG
 370                 LINE     EQU   1              LINE MASK
 380                 DOT      EQU   2              DOT COUNTER
 390                 ROW      EQU   3              ROW COUNTER
 400                 STOR1    EQU   4              DOT STORAGE LSB
 410                 STOR2    EQU   5              DOT STORAGE MSB
 420                 PRFLG    EQU   6              PRINT FLAG
 430                 CHR      EQU   7              CHARACTER COUNTER
 440                 TEMP     EQU   8              TEMPORARY BUFFER STORAGE
 450                 *
 460                 BUFAD    EQU   O'70'          ASCII CONV. BUFFER START
 470                 BUFP     EQU   38
 480                 ADDR     EQU   O'20'          ISAR-1 BUFFER ADDRESS
 490                 PTOT     EQU   4
 500                 MTOT     EQU   8
 510                 PMOT     EQU   5              MOTOR PORT
 520                 MOTON    EQU   H'C0'          MOTOR ON BYTE
 530                 MOTOF    EQU   H'40'          MOTOR OFF BYTE
 540                 PDOTL    EQU   0              PORT LSB DOTS
 550                 PDOTH    EQU   1              PORT MSB DOTS
 560                 PORT     EQU   4              PORT INPUT SIGNALS
 570                 MPSTRT   EQU   1              MASK PRINT START
 580                 MSTP1    EQU   2              MASK STROBE P1
 590                 MSTP2    EQU   4              MASK STROBE P2
 600                 PMODE    EQU   4
 610                 MMODE    EQU   H'20'
 620                 PSEL     EQU   4
 630                 MSEL     EQU   H'10'
 640                 PSW      EQU   4
 650                 MSTOP    EQU   H'40'
 660                 HB       EQU   0
 670                 MB       EQU   1
 680                 LB       EQU   2
 690                 HB1      EQU   3
```

```
                MB1       EQU   4
                LB1       EQU   5
                IDST      EQU   H'2000'        ID # STORAGE
                TIMST     EQU   H'2002'        TIMECODE
                MONTL     EQU   H'2004'        TOTAL MONEY NON-RESETTING
                RMONTL    EQU   H'2007'        RESET MONEY TOTAL
                PFAIL     EQU   H'200A'        POWER FAIL BYTE
                MAXIT     EQU   H'200B'        MAX. ITEMS
                PRTFL     EQU   H'200C'        PRTFL BUFFER CLEAR FLAG
                STORE     EQU   H'200D'        START OF SEL. STORAGE
                *
                BUF1      EQU   O'21'
                BUF2      EQU   O'24'
                BUF3      EQU   O'30'
                BUF4      EQU   O'36'
                BUF5      EQU   O'40'
                *
                * END GLOBAL DECLARATIONS
                *
                *
                *
0000 20 FF                LI    H'FF'
0002 B0                   OUTS  0
0003 73                   LIS   3
0004 B1                   OUTS  1
0005 70                   CLR
0006 B4                   OUTS  4
0007 B5                   OUTS  5
                *
                *
                *  INCREMENT POWER DOWN
0008 2A 20 0A             DCI   PFAIL
000B 16                   LM
000C 2A 20 0A             DCI   PFAIL
000F 1F                   INC
0010 17                   ST
                *
                * INIT BUFFER CLEAR FLAG
                *
0011 2A 20 0C             DCI   PRTFL
0014 70                   CLR
0015 17                   ST
                *
                *
0016 20 32                LI    O'62'          INIT TIME BUFFER
0018 0B                   LR    IS,A
0019 20 CF                LI    207
001B 5D                   LR    I,A
001C 73                   LIS   3
001D 5C                   LR    S,A
                *
001E 70         MODE      CLR                  RELAY ON
001F B5                   OUTS  5
                *
0020 A4                   INS   PORT           CHECK ERASE
0021 21 80                NI    H'80'
0023 84 07                BZ    MODE1
0025 28 01 AC             PI    ERASE
0028 28 04 EC             PI    PRTLN
                *
002B A4         MODE1     INS   PMODE          CHECK PRINT SWITCH
002C 21 20                NI    MMODE
002E 84 07                BZ    A1             SKIP IF OFF
0030 20 40                LI    H'40'          RELAY OFF
0032 B5                   OUTS  5
0033 29 01 C7             JMP   DUMP           PRINT IT
0036 20 30      A1        LI    O'60'          TIME BUFFER
0038 0B                   LR    IS,A
0039 3D                   DS    I
003A 82 1F                BC    A2
```

```
1400 003C 3D                DS    I
1410 003D 82 1C             BC    A2
1420 003F 3C                DS    S
1430 0040 82 19             BC    A2
1440 0042 20 CF             LI    207
1450 0044 5D                LR    I,A
1460 0045 3C                DS    S
1470 0046 82 13             BC    A2
1480 0048 73                LIS   3
1490 0049 5C                LR    S,A
1500 004A 2A 20 02          DCI   TIMST
1510                 *  INCREMENT TIME
1520 004D 0E                LR    Q,DC
1530 004E 16                LM
1540 004F 51                LR    MB,A
1550 0050 16                LM
1560 0051 24 01             AI    1
1570 0053 52                LR    LB,A
1580 0054 41                LR    A,MB
1590 0055 19                LNK
1600 0056 0F                LR    DC,Q
1610 0057 17                ST
1620 0058 42                LR    A,LB
1630 0059 17                ST
1640                 *
1650 005A A4         A2     INS   PSEL        LOOK FOR SEL TRANSITION
1660 005B 21 10             NI    MSEL
1670 005D 84 C0             BZ    MODE        LOOP BACK
1680                 *
1690                 * END OF MAIN LOOP
1700                 *
1710 005F 70                CLR
1720 0060 50                LR    CNT,A
1730 0061 53                LR    CNT1,A      CLEAR STORAGE
1740 0062 A4         X1     INS   PSEL        LOOK AT SEL
1750 0063 21 10             NI    MSEL
1760 0065 84 08             BZ    X2          TRANSITION; BRANCH
1770 0067 40                LR    A,CNT
1780 0068 1F                INC
1790 0069 50                LR    CNT,A
1800 006A 84 B3             BZ    MODE        ERROR; SEL STUCK
1810 006C 90 F5             BR    X1
1820                 *
1830 006E 40         X2     LR    A,CNT
1840 006F 25 28             CI    40          CHECK FOR UNDER WIDTH
1850 0071 92 06             BNC   X3          OK
1860 0073 43                LR    A,CNT1
1870 0074 21 FF             NI    H'FF'
1880 0076 84 A7             BZ    MODE        NOISE; RETURN TO TOP
1890 0078 70         X3     CLR
1900 0079 50                LR    CNT,A       CLEAR STORAGE
1910 007A A4         X4     INS   PSEL        LOOK FOR OPPOSITE TRANS
1920 007B 21 10             NI    MSEL
1930 007D 94 0A             BNZ   X5          TRANSITION; BRANCH
1940 007F 40                LR    A,CNT       INC TIMER
1950 0080 1F                INC
1960 0081 50                LR    CNT,A
1970 0082 25 48             CI    72          CHECK FOR RUN-OUT
1980 0084 92 0A             BNC   X6          YES
1990 0086 90 F3             BR    X4
2000 0088 70         X5     CLR               CLEAR STORAGE
2010 0089 50                LR    CNT,A
2020 008A 43                LR    A,CNT1      INCR. DATA
2030 008B 1F                INC
2040 008C 53                LR    CNT1,A
2050 008D 90 D4             BR    X1          LOOK FOR NEXT ONE
2060                 *
2070 008F 43         X6     LR    A,CNT1      LAST INCR
2080 0090 1F                INC
2090 0091 53                LR    CNT1,A
```

```
0092 70                CLR                    END OF SEL PULSES; LOOK FOR
0093 50                LR    CNT,A            TOT
0094 A4        X7      INS   PTOT
0095 21 08             NI    MTOT
0097 94 0B             BNZ   X8
0099 40                LR    A,CNT
009A 1F                INC
009B 50                LR    CNT,A
009C 25 4B             CI    75               CHECK FOR RUN-OUT
009E 82 F5             BC    X7
00A0 29 00 1E XXXX     JMP   MODE             IGNORE; FREE VEND
               *
00A3 70        X8      CLR                    CLEAR STORAGE
00A4 50                LR    CNT,A
00A5 54                LR    CNT2,A
00A6 55                LR    CNT3,A
00A7 A4        X9      INS   PTOT
00A8 21 08             NI    MTOT             CHECK FOR TOT TRANS
00AA 84 0B             BZ    X11              YES; TRANSITION
00AC 35        X10     DS    CNT3             DELAY
00AD 94 FE             BNZ   X10
00AF 40                LR    A,CNT
00B0 1F                INC                    INCREMENT COUNTER
00B1 50                LR    CNT,A
00B2 84 ED             BZ    XXXX             RUNOUT; LINE STUCK
00B4 90 F2             BR    X9               LOOK AGAIN
00B6 40        X11     LR    A,CNT
00B7 25 05             CI    5                CHECK FOR MINIMUM
00B9 92 06             BNC   X12              LONG ENOUGH
00BB 43                LR    A,CNT1
00BC 21 FF             NI    H'FF'
00BE 84 D5             BZ    X7               NOISE
00C0 70        X12     CLR                    CLEAR STORAGE
00C1 50                LR    CNT,A
00C2 A4        X13     INS   PTOT
00C3 21 08             NI    MTOT
00C5 94 0D             BNZ   X14              NEW TRANS DETECTED
00C7 35        X131    DS    CNT3
00C8 94 FE             BNZ   X131             WASTE TIME
00CA 40                LR    A,CNT
00CB 1F                INC
00CC 50                LR    CNT,A
00CD 25 1E             CI    30
00CF 92 0A             BNC   X15              END OF PULSES DETECTED
00D1 90 F0             BR    X13              LOOK FOR TRANS
00D3 70        X14     CLR                    TRANS DETECTED
00D4 50                LR    CNT,A
00D5 44                LR    A,CNT2
00D6 1F                INC
00D7 54                LR    CNT2,A           INCREMENT DATA
00D8 90 CE             BR    X9               LOOK FOR ANOTHER PULSE
               *
               * DATA IS COLLECTED; NOW DO SOMETHING WITH IT
               *
00DA 44        X15     LR    A,CNT2           LAST INCREMENT
00DB 1F                INC
00DC 54                LR    CNT2,A
00DD 43                LR    A,CNT1           CHECK SEL # FOR VALID #
00DE 25 20             CI    32               MAX NO.
00E0 82 04             BC    X151             OK; SKIP
00E2 29 00 1E          JMP   MODE
               *
00E5 2A 20 0C X151     DCI   PRTFL            CHECK BUFFER CLEAR FLAG
00E8 16                LM
00E9 21 FF             NI    H'FF'
00EB 84 1F             BZ    X16              DON'T CLEAR
               *
               * CLEAR THE BUFFER
               *
00ED 2A 20 07          DCI   RMONTL           CLEAR RESETTABLE MONEY TOTAL
```

```
2800 00F0 70                CLR
2810 00F1 17                ST
2820 00F2 17                ST
2830 00F3 17                ST
2840 00F4 17                ST                      CLEAR PFAIL
2850 00F5 71                LIS   1
2860 00F6 17                ST                      CLEAR MAXIT
2870                *
2880 00F7 2A 20 0D          DCI   STORE
2890 00FA 20 1E             LI    30
2900 00FC 50                LR    CNT,A
2910 00FD 70                CLR
2920 00FE 17        CLBUF   ST
2930 00FF 17                ST
2940 0100 76                LIS   6
2950 0101 8E                ADC
2960 0102 70                CLR
2970 0103 30                DS    CNT
2980 0104 94 F9             BNZ   CLBUF             CONTINUE UNTIL DONE
2990                *
3000 0106 2A 20 0C          DCI   PRTFL             CLEAR FLAG
3010 0109 70                CLR
3020 010A 17                ST
3030                *
3040                *
3050 010B 2A 20 04  X16     DCI   MONTL
3060 010E 28 01 70          PI    ADD               ADD NICKELS TO MONTL
3070 0111 28 01 70          PI    ADD               ADD NICKELS TO RMONTL
3080                *
3090 0114 33                DS    CNT1              INDEX = SEL-3
3100 0115 33                DS    CNT1
3110 0116 2A 20 0B          DCI   MAXIT             CHECK MAX. ITEMS
3120 0119 0E                LR    Q,DC
3130 011A 16                LM
3140 011B 25 00             CI    0
3150 011D 84 09             BZ    X161
3160 011F 18                COM
3170 0120 24 01             AI    1                 FORM 2'S COMPLEMENT
3180 0122 50                LR    HB,A
3190 0123 43                LR    A,CNT1
3200 0124 C0                AS    HB
3210 0125 92 04             BNC   X17               FORMER MAXIT LARGER; SKIP
3220 0127 0F        X161    LR    DC,Q
3230 0128 43                LR    A,CNT1            GET NEW MAXIT
3240 0129 17                ST                      SAVE IT
3250                *
3260 012A 33        X17     DS    CNT1
3270 012B 2A 20 0D          DCI   STORE             BASE TO RAM
3280 012E 43                LR    A,CNT1
3290 012F 13                SL    1                 X2
3300 0130 13                SL    1
3310 0131 8E                ADC
3320 0132 8E                ADC                     INDEX*8+BASE=ADDRESS
3330 0133 0E                LR    Q,DC              SAVE DCO
3340 0134 16                LM
3350 0135 51                LR    MB,A
3360 0136 16                LM
3370 0137 24 01             AI    1                 ADD 1 TO IR
3380 0139 52                LR    LB,A
3390 013A 41                LR    A,MB
3400 013B 19                LNK                     ADD CARRY
3410 013C 51                LR    MB,A
3420 013D 0F                LR    DC,Q              RESET DCO
3430 013E 41                LR    A,MB
3440 013F 17                ST
3450 0140 42                LR    A,LB              REPLACE IR
3460 0141 17                ST
3470 0142 0E                LR    Q,DC              SAVE DCO
3480 0143 16                LM                      GET INR
3490 0144 50                LR    HB,A
```

```
3500 0145 16                LM
3510 0146 51                LR    MB,A
3520 0147 16                LM
3530 0148 24 01             AI    1              ADD 1 VEND
3540 014A 52                LR    LB,A
3550 014B 41                LR    A,MB
3560 014C 19                LNK
3570 014D 51                LR    MB,A
3580 014E 40                LR    A,HB
3590 014F 19                LNK
3600 0150 50                LR    HB,A
3610 0151 25 01             CI    1              CHECK FOR OVERFLOW
3620 0153 94 0F             BNZ   REPX           OK; REPXACE DATA
3630 0155 41                LR    A,MB           CHECK MB
3640 0156 25 86             CI    H'86'
3650 0158 94 0A             BNZ   REPX           OK; REPXACE DATA
3660 015A 42                LR    A,LB
3670 015B 25 9F             CI    H'9F'
3680 015D 82 05             BC    REPX
3690 015F 70                CLR                  OVERFLOW; CLEAR
3700 0160 52                LR    LB,A
3710 0161 51                LR    MB,A
3720 0162 50                LR    HB,A
3730 0163 0F        REPX    LR    DC,Q           RESET DCO
3740 0164 40                LR    A,HB
3750 0165 17                ST
3760 0166 41                LR    A,MB
3770 0167 17                ST
3780 0168 42                LR    A,LB
3790 0169 17                ST
3800                *
3810 016A 28 01 70          PI    ADD            ADD NICKELS TO $NR
3820                *
3830                *
3840                * END OF SAVE ROUTINE
3850                *
3860 016D 29 00 1E          JMP   MODE           RETURN TO MAIN LOOP
3870                *
3880 0170 0E        ADD     LR    Q,DC           SAVE DCO
3890 0171 16                LM                   GET VAL
3900 0172 50                LR    HB,A
3910 0173 16                LM
3920 0174 51                LR    MB,A
3930 0175 16                LM
3940 0176 C4                AS    CNT2           ADD NICKELS
3950 0177 52                LR    LB,A
3960 0178 41                LR    A,MB
3970 0179 19                LNK
3980 017A 51                LR    MB,A
3990 017B 40                LR    A,HB
4000 017C 19                LNK
4010 017D 50                LR    HB,A
4020 017E 25 03             CI    3              CHECK FOR OVERFLOW
4030 0180 92 15             BNC   OVER           OVERFLOW
4040 0182 84 03             BZ    CK3            CHECK NEXT DIGIT
4050 0184 90 1F             BR    RPL1           REPLACE DATA
4060 0186 41        CK3     LR    A,MB           CHECK MB
4070 0187 25 0D             CI    H'0D'
4080 0189 92 0C             BNC   OVER
4090 018B 84 03             BZ    CK4            EQUAL; CHECK NEXT DIGIT
4100 018D 90 16             BR    RPL1           REPLACE DATA
4110 018F 42        CK4     LR    A,LB           CHECK LB
4120 0190 25 3F             CI    H'3F'
4130 0192 92 03             BNC   OVER
4140 0194 90 0F             BR    RPL1           EQUAL OR LESS, OK REPLACE
4150 0196 42        OVER    LR    A,LB           SUBTRACT 200000
4160 0197 24 C0             AI    H'C0'
4170 0199 52                LR    LB,A
4180 019A 41                LR    A,MB
4190 019B 19                LNK
```

```
4200 019C 24 F2                AI    H'F2'
4210 019E 51                   LR    MB,A
4220 019F 40                   LR    A,HB
4230 01A0 19                   LNK
4240 01A1 24 FC                AI    H'FC'
4250 01A3 50                   LR    HB,A
4260 01A4 0F          RPL1     LR    DC,Q          RESET DC0
4270 01A5 40                   LR    A,HB
4280 01A6 17                   ST
4290 01A7 41                   LR    A,MB
4300 01A8 17                   ST
4310 01A9 42                   LR    A,LB
4320 01AA 17                   ST
4330 01AB 1C                   POP                 END OF SUBROUTINE
4340                  *
4350                  * ERASE ROUTINE
4360                  *
4370 01AC 70          ERASE    CLR                 CLEAR COUNTER
4380 01AD 50                   LR    CNT,A
4390 01AE A4          ER1      INS   PORT
4400 01AF 21 80                NI    H'80'
4410 01B1 94 04                BNZ   ER2
4420 01B3 29 00 1E             JMP   MODE
4430 01B6 30          ER2      DS    CNT
4440 01B7 94 F6                BNZ   ER1
4450 01B9 2A 20 00 J           DCI   IDST
4460 01BC 70                   CLR
4470 01BD 17          ER3      ST                  ERASE BUFFER
4480 01BE 30                   DS    CNT
4490 01BF 94 FD                BNZ   ER3
4500 01C1 2A 20 0B             DCI   MAXIT
4510 01C4 71                   LIS   1
4520 01C5 17                   ST
4530 01C6 1C                   POP
4540                  *
4550                  *
4560                  * START OF PRINT ROUTINE
4570                  *
4580                  *
4590 01C7 28 06 0B    DUMP     PI    CLEAR         CLEAR BUFFER
4600                  *
4610                  *
4620                  *
4630                  * PRINT 1 BLANK LINE
4640                  *
4650 01CA 28 04 EC             PI    PRTLN
4660 01CD 28 03 D6             PI    STOP
4670                  *
4680                  * PRINT HEADER
4690                  *
4700 01D0 20 12                LI    O'22'
4710 01D2 50                   LR    CNT,A
4720 01D3 40          H1       LR    A,CNT
4730 01D4 0B                   LR    IS,A
4740 01D5 20 2A                LI    C'*'
4750 01D7 5C                   LR    S,A
4760 01D8 40                   LR    A,CNT
4770 01D9 1F                   INC
4780 01DA 50                   LR    CNT,A
4790 01DB 25 23                CI    O'43'
4800 01DD 82 F5                BC    H1
4810 01DF 28 04 EC             PI    PRTLN
4820 01E2 20 12                LI    O'22'
4830 01E4 50                   LR    CNT,A
4840 01E5 2A 07 59             DCI   HBUF1
4850 01E8 28 04 00             PI    HD1
4860 01EB 28 04 EC             PI    PRTLN
4870 01EE 28 03 D6             PI    STOP
4880 01F1 28 04 EC             PI    PRTLN
4890 01F4 20 13                LI    O'23'
```

```
4900 01F6 50                LR    CNT,A
4910 01F7 2A 07 6C          DCI   HBUF2
4920 01FA 28 04 00          PI    HD1
4930 01FD 28 04 EC          PI    PRTLN
4940 0200 20 17             LI    0'27'
4950 0202 50                LR    CNT,A
4960 0203 2A 07 7D          DCI   HBUF3
4970 0206 28 04 00          PI    HD1
4980 0209 28 04 EC          PI    PRTLN
4990 020C 28 04 EC          PI    PRTLN
5000 020F 28 03 D6          PI    STOP
5010                *
5020                * PRINT ID #
5030                *
5040 0212 70        READ    CLR                     CLEAR STORAGE
5050 0213 50                LR    HB,A
5060 0214 51                LR    MB,A
5070 0215 52                LR    LB,A
5080 0216 73                LIS   3                 INIT PORT
5090 0217 B1                OUTS  1
5100 0218 77                LIS   7
5110 0219 55                LR    CNT3,A            SET COUNTER
5120 021A 45        XO      LR    A,CNT3
5130 021B 18                COM
5140 021C B5                OUTS  5
5150 021D A1                INS   1
5160 021E 21 40             NI    H'40'             MASK FOR PA-6
5170 0220 84 05             BZ    XA
5180 0222 20 80             LI    H'80'
5190 0224 C1                AS    MB              ADD A 1
5200 0225 51                LR    MB,A            SAVE RESULT
5210 0226 A1        XA      INS   1
5220 0227 21 80             NI    H'80'             MASK FOR PA-5
5230 0229 84 05             BZ    XB
5240 022B 20 80             LI    H'80'
5250 022D C2                AS    LB
5260 022E 52                LR    LB,A            SAVE
5270 022F 35        XB      DS    CNT3
5280 0230 92 09             BNC   XC
5290 0232 41                LR    A,MB
5300 0233 12                SR    1
5310 0234 51                LR    MB,A            SAVE SHIFTED RESULT
5320 0235 42                LR    A,LB
5330 0236 12                SR    1                 SHIFT
5340 0237 52                LR    LB,A            SAVE
5350 0238 90 E1             BR    XO                RETURN & CONTINUE
5360                *
5370 023A 28 04 34  XC      PI    ASCII             CONVERT IT
5380                *
5390                * LOAD BUFFER FOR PRINTING
5400                *
5410 023D 20 11             LI    ADDR+1
5420 023F 0B                LR    IS,A
5430 0240 20 49             LI    C'I'              ID #
5440 0242 5D                LR    I,A
5450 0243 20 44             LI    C'D'
5460 0245 5D                LR    I,A
5470 0246 4D                LR    A,I               INCREMENT ISAR
5480 0247 20 23             LI    C'#'
5490 0249 5D                LR    I,A
5500 024A 20 39             LI    BUFAD+1           ASCII OUTPUT BUFFER
5510 024C 0B                LR    IS,A
5520 024D 75                LIS   5                 INIT COUNTER
5530 024E 50                LR    CNT,A
5540 024F 28 03 E6          PI    LDX2              SHIFT INTO PRINT BUFFER
5550                *
5560 0252 28 04 EC          PI    PRTLN             PRINT THE LINE
5570                *
5580                * CHECK STOP
5590                *
```

```
5600 0255 28 03 D6          PI    STOP
5610                 *
5620                 * PRINT TIMECODE
5630                 *
5640 0258 2A 20 02          DCI   TIMST
5650 025B 28 03 F5          PI    LOAD2
5660 025E 28 04 34          PI    ASCII
5670                 *
5680                 * LOAD BUFFER FOR TIMECODE
5690                 *
5700 0261 20 11             LI    ADDR+1
5710 0263 0B                LR    IS,A
5720 0264 20 54             LI    C'T'
5730 0266 5D                LR    I,A            TC
5740 0267 20 48             LI    C'H'
5750 0269 5D                LR    I,A
5760 026A 20 39             LI    BUFAD+1
5770 026C 0B                LR    IS,A           ADDRESS ASCII BUFFER
5780 026D 75                LIS   5
5790 026E 50                LR    CNT,A
5800 026F 28 03 E6          PI    LDX2           TRANSFER TO PRINT BUFFER
5810                 *
5820 0272 28 04 EC          PI    PRTLN          PRINT IT
5830                 *
5840                 * CHECK STOP
5850                 *
5860 0275 28 03 D6          PI    STOP
5870                 *
5880                 *
5890 0278 28 04 EC          PI    PRTLN          PRINT EMPTY LINE
5900                 *
5910                 * CHECK STOP
5920                 *
5930 027B 28 03 D6          PI    STOP
5940                 *
5950                 *
5960                 *  PRINT NON-RESET TOTAL MONEY
5970                 *
5980 027E 2A 20 04          DCI   MONTL
5990 0281 28 03 EE          PI    LOAD3
6000 0284 28 04 10          PI    NICKL          CONVERT NICKELS TO ASCII
6010                 *
6020                 * LOAD PRINT BUFFER
6030                 *
6040 0287 20 11             LI    ADDR+1
6050 0289 0B                LR    IS,A
6060 028A 20 54             LI    C'T'           T $
6070 028C 5D                LR    I,A
6080 028D 20 4E             LI    C'N'
6090 028F 5D                LR    I,A
6100 0290 20 52             LI    C'R'
6110 0292 5D                LR    I,A
6120 0293 4D                LR    A,I            SKIP SPACE
6130 0294 4D                LR    A,I
6140 0295 20 24             LI    C'$'
6150 0297 5D                LR    I,A
6160 0298 20 38             LI    BUFAD
6170 029A 0B                LR    IS,A
6180 029B 76                LIS   6
6190 029C 50                LR    CNT,A
6200 029D 28 03 E6          PI    LDX2           TRANSFER ASCII TO PRINT BUFFER
6210 02A0 28 03 DC          PI    DP             ADD THE DECIMAL POINT
6220                 *
6230 02A3 28 04 EC          PI    PRTLN          PRINT IT
6240                 *
6250                 * CHECK STOP
6260                 *
6270 02A6 28 03 D6          PI    STOP
6280                 *
6290                 * PRINT RESET TOTAL MONEY
```

```
6300                    *
6310 02A9 2A 20 07              DCI   RMONTL
6320 02AC 28 03 EE              PI    LOAD3
6330 02AF 28 04 10              PI    NICKL
6340                    *
6350                    * LOAD PRINT BUFFER
6360                    *
6370 02B2 20 11                 LI    BUF1
6380 02B4 0B                    LR    IS,A
6390 02B5 20 54                 LI    C'T'
6400 02B7 5D                    LR    I,A
6410 02B8 20 52                 LI    C'R'          TR $
6420 02BA 5D                    LR    I,A
6430 02BB 4D                    LR    A,I           SKIP SPACE
6440 02BC 4D                    LR    A,I
6450 02BD 4D                    LR    A,I
6460 02BE 20 24                 LI    C'$'
6470 02C0 5D                    LR    I,A
6480 02C1 20 38                 LI    BUFAD
6490 02C3 0B                    LR    IS,A
6500 02C4 76                    LIS   6
6510 02C5 50                    LR    CNT,A
6520 02C6 28 03 E6              PI    LDX2          SHIFT ASCII INTO PRINT BUFFER
6530 02C9 28 03 DC              PI    DP            ADD DEC. PT.
6540 02CC 28 04 EC              PI    PRTLN         PRINT THE LINE
6550                    *
6560                    * CHECK STOP
6570                    *
6580 02CF 28 03 D6              PI    STOP
6590                    *
6600 02D2 28 04 EC              PI    PRTLN
6610                    *
6620                    * PRINT POWER FAIL
6630                    *
6640 02D5 2A 20 0A              DCI   PFAIL
6650 02D8 70                    CLR
6660 02D9 50                    LR    HB,A
6670 02DA 51                    LR    MB,A
6680 02DB 16                    LM
6690 02DC 52                    LR    LB,A
6700 02DD 28 04 34              PI    ASCII         CONVERT IT
6710                    *
6720                    * LOAD PRINT BUFFER
6730                    *
6740 02E0 20 11                 LI    BUF1
6750 02E2 0B                    LR    IS,A
6760 02E3 20 50                 LI    C'P'
6770 02E5 5D                    LR    I,A
6780 02E6 20 49                 LI    C'I'
6790 02E8 5D                    LR    I,A
6800 02E9 20 3B                 LI    BUFAD+3
6810 02EB 0B                    LR    IS,A
6820 02EC 73                    LIS   3
6830 02ED 50                    LR    CNT,A
6840 02EE 28 03 E6              PI    LDX2          MOVE CHARS.
6850 02F1 28 04 EC              PI    PRTLN         PRINT THE LINE
6860                    *
6870                    * CHECK STOP
6880                    *
6890 02F4 28 03 D6              PI    STOP
6900                    *
6910                    *
6920                    * PRINT HEADER
6930                    *
6940 02F7 28 04 EC              PI    PRTLN
6950                    *
6960 02FA 28 03 D6              PI    STOP
6970                    *
6980                    * PRINT HEADER
6990                    *
```

```
7000 02FD 20 11              LI     BUF1
7010 02FF 0B                 LR     IS,A
7020 0300 20 53              LI     C'S'
7030 0302 5D                 LR     I,A
7040 0303 20 23              LI     C'#'
7050 0305 5D                 LR     I,A
7060 0306 4D                 LR     A,I
7070 0307 20 49              LI     C'I'
7080 0309 5D                 LR     I,A
7090 030A 20 52              LI     C'R'
7100 030C 5D                 LR     I,A
7110 030D 20 18              LI     BUF3
7120 030F 0B                 LR     IS,A
7130 0310 20 49              LI     C'I'
7140 0312 5D                 LR     I,A
7150 0313 20 4E              LI     C'N'
7160 0315 5D                 LR     I,A
7170 0316 20 52              LI     C'R'
7180 0318 5D                 LR     I,A
7190 0319 20 1E              LI     BUF4
7200 031B 0B                 LR     IS,A
7210 031C 20 24              LI     C'$'
7220 031E 5D                 LR     I,A
7230 031F 20 4E              LI     C'N'
7240 0321 5D                 LR     I,A
7250 0322 64                 LISU   4
7260 0323 20 52              LI     C'R'
7270 0325 5D                 LR     I,A
7280 0326 28 04 EC           PI     PRTLN
7290                 *
7300                 * CHECK STOP
7310                 *
7320 0329 28 03 D6           PI     STOP
7330                 *
7340                 *
7350                 *
7360                 *  INIT SEL # PRINT LOOP
7370                 *
7380 032C 20 26              LI     BUFP
7390 032E 0B                 LR     IS,A
7400 032F 2A 20 0B           DCI    MAXIT          GET MAX ITEMS
7410 0332 16                 LM
7420 0333 25 1E              CI     30
7430 0335 82 03              BC     MX1
7440 0337 20 1E              LI     30
7450 0339 5D         MX1     LR     I,A
7460 033A 70                 CLR
7470 033B 5C                 LR     S,A            INDEX FOR SEL. DATA
7480                 *
7490                 * PRINT LOOP
7500 033C 20 27      DLOOP   LI     BUFP+1
7510 033E 0B                 LR     IS,A           GET INDEX
7520 033F 4C                 LR     A,S
7530 0340 1F                 INC                   CONVERT INDEX
7540 0341 52                 LR     LB,A
7550 0342 70                 CLR
7560 0343 51                 LR     MB,A
7570 0344 50                 LR     HB,A
7580 0345 28 04 34           PI     ASCII          CONVERT
7590 0348 28 03 C9           PI     MOVA           MOVE TO DIRECT SCRATCHPAD
7600 034B 20 11              LI     BUF1           FIRST BUFFER
7610 034D 0B                 LR     IS,A
7620 034E 44                 LR     A,4
7630 034F 5D                 LR     I,A
7640 0350 45                 LR     A,5
7650 0351 5D                 LR     I,A
7660 0352 20 27              LI     BUFP+1         GET INDEX
7670 0354 0B                 LR     IS,A
7680 0355 2A 20 0D           DCI    STORE          BASE RAM ADDRESS
7690 0358 4C                 LR     A,S            GET INDEX
```

```
7700 0359 13                SL    1
7710 035A 13                SL    1              X4
7720 035B 8E                ADC                  ADD TO DC
7730 035C 8E                ADC                  ADD TO DC INDEX X8
7740 035D 28 03 F5          PI    LOAD2          ITEMS RESET TO CONVERTER
7750 0360 28 04 34          PI    ASCII
7760 0363 28 03 C9          PI    MOVA
7770 0366 20 14             LI    BUF2           STICK IT IN 2ND BUFFER
7780 0368 0B                LR    IS,A
7790 0369 43                LR    A,3
7800 036A 5D                LR    I,A
7810 036B 44                LR    A,4
7820 036C 5D                LR    I,A
7830 036D 45                LR    A,5
7840 036E 5D                LR    I,A
7850                 *
7860 036F 28 03 EE          PI    LOAD3          ITEMS NON-RESET
7870 0372 28 04 34          PI    ASCII
7880 0375 28 03 C9          PI    MOVA
7890 0378 20 18             LI    BUF3
7900 037A 0B                LR    IS,A
7910 037B 41                LR    A,1
7920 037C 5D                LR    I,A
7930 037D 42                LR    A,2
7940 037E 5D                LR    I,A
7950 037F 43                LR    A,3
7960 0380 5D                LR    I,A
7970 0381 44                LR    A,4
7980 0382 5D                LR    I,A
7990 0383 45                LR    A,5
8000 0384 5D                LR    I,A
8010                 *
8020 0385 28 03 EE          PI    LOAD3          NICKELS NON-RESET
8030 0388 28 04 10          PI    NICKL
8040 038B 28 03 C9          PI    MOVA
8050 038E 20 1E             LI    BUF4
8060 0390 0B                LR    IS,A
8070 0391 40                LR    A,0
8080 0392 5D                LR    I,A
8090 0393 41                LR    A,1
8100 0394 5D                LR    I,A
8110 0395 20 20             LI    BUF5
8120 0397 0B                LR    IS,A
8130 0398 42                LR    A,2
8140 0399 5D                LR    I,A
8150 039A 43                LR    A,3
8160 039B 5D                LR    I,A
8170 039C 20 2E             LI    C'.'
8180 039E 5D                LR    I,A
8190 039F 44                LR    A,4
8200 03A0 5D                LR    I,A
8210 03A1 45                LR    A,5
8220 03A2 5D                LR    I,A
8230 03A3 28 04 EC          PI    PRTLN          PRINT THE LINE
8240 03A6 28 03 D6          PI    STOP
8250 03A9 20 27             LI    BUFP+1
8260 03AB 0B                LR    IS,A
8270 03AC 4C                LR    A,S            INCREMENT INDEX
8280 03AD 1F                INC
8290 03AE 5E                LR    D,A
8300 03AF 3C                DS    S              DECR MAXIT
8310 03B0 94 8B             BNZ   DLOOP
8320                 *
8330                 *
8340                 * SET PRTFL
8350                 *
8360 03B2 2A 20 0C          DCI   PRTFL
8370 03B5 7F                LIS   15
8380 03B6 17                ST
8390                 *
```

```
8400                    * END OF PRINT LOOP
8410                    *
8420                    * PRINT 5 LINES
8430                    *
8440 03B7 28 04 EC              PI     PRTLN
8450 03BA 28 04 EC              PI     PRTLN
8460 03BD 28 04 EC              PI     PRTLN
8470 03C0 28 04 EC              PI     PRTLN
8480 03C3 28 04 EC              PI     PRTLN
8490                    *
8500                    *
8510 03C6 29 00 1E PREND        JMP    MODE            GO BACK; DONE
8520                    *
8530                    *
8540                    *
8550 03C9 20 38    MOVA         LI     BUFAD
8560 03CB 0B                    LR     IS,A
8570 03CC 76                    LIS    6
8580 03CD 57                    LR     7,A
8590 03CE 67       MOVA1        LISU   7
8600 03CF 4C                    LR     A,S
8610 03D0 60                    LISU   0
8620 03D1 5D                    LR     I,A
8630 03D2 37                    DS     7
8640 03D3 94 FA                 BNZ    MOVA1
8650 03D5 1C                    POP
8660                    *
8670 03D6 A4       STOP         INS    PSW
8680 03D7 21 40                 NI     MSTOP
8690 03D9 94 EC                 BNZ    PREND           STOP IF NECC.
8700 03DB 1C                    POP
8710                    *
8720                    *
8730                    *
8740 03DC 5E       DP           LR     D,A             DECIMAL POINT ADDER
8750 03DD 4D                    LR     A,I
8760 03DE 5E                    LR     D,A
8770 03DF 4E                    LR     A,D
8780 03E0 4D                    LR     A,I
8790 03E1 5E                    LR     D,A
8800 03E2 20 2E                 LI     C'.'
8810 03E4 5C                    LR     S,A
8820 03E5 1C                    POP
8830                    *
8840 03E6 67       LDX2         LISU   7
8850 03E7 4C                    LR     A,S
8860 03E8 63                    LISU   3
8870 03E9 5D                    LR     I,A
8880 03EA 30                    DS     CNT
8890 03EB 94 FA                 BNZ    LDX2
8900 03ED 1C                    POP
8910 03EE 16       LOAD3        LM
8920 03EF 50                    LR     HB,A
8930 03F0 16                    LM
8940 03F1 51                    LR     MB,A
8950 03F2 16                    LM
8960 03F3 52                    LR     LB,A
8970 03F4 1C                    POP
8980 03F5 70       LOAD2        CLR
8990 03F6 50                    LR     HB,A
9000 03F7 16                    LM
9010 03F8 51                    LR     MB,A
9020 03F9 16                    LM
9030 03FA 52                    LR     LB,A
9040 03FB 1C                    POP
9050                    *
9060                            ORG    H'400'
9070                    *
9080                    * ASCII LOADER
9090                    *
```

```
9100 0400 40        HD1      LR    A,CNT
9110 0401 0B                 LR    IS,A
9120 0402 16                 LM
9130 0403 5C                 LR    S,A
9140 0404 40                 LR    A,CNT
9150 0405 1F                 INC
9160 0406 50                 LR    CNT,A
9170 0407 4C                 LR    A,S
9180 0408 25 0D              CI    H'0D'
9190 040A 94 F5              BNZ   HD1
9200 040C 20 20              LI    H'20'
9210 040E 5C                 LR    S,A
9220 040F 1C                 POP
9230                 *
9240                 *
9250                 *  NICKEL TO BINARY CONVERTER
9260                 *  (BASE 5 TO BASE 2 CONVERTER)
9270                 *
9280 0410 40        NICKL    LR    A,HB          MASK FOR OVERFLOW
9290 0411 21 03              NI    3
9300 0413 50                 LR    HB,A          SAVE
9310 0414 13                 SL    1             X4 HB
9320 0415 13                 SL    1
9330 0416 53                 LR    HB1,A
9340 0417 41                 LR    A,MB
9350 0418 14                 SR    4
9360 0419 12                 SR    1
9370 041A 12                 SR    1
9380 041B C3                 AS    HB1
9390 041C 53                 LR    HB1,A         SAVE HBX4
9400 041D 41                 LR    A,MB          X4 MB
9410 041E 13                 SL    1
9420 041F 13                 SL    1
9430 0420 54                 LR    MB1,A
9440 0421 42                 LR    A,LB
9450 0422 14                 SR    4
9460 0423 12                 SR    1
9470 0424 12                 SR    1
9480 0425 C4                 AS    MB1
9490 0426 54                 LR    MB1,A         SAVE MBX4
9500 0427 42                 LR    A,LB          X4LB
9510 0428 13                 SL    1
9520 0429 13                 SL    1
9530 042A C2                 AS    LB            ADD LB X1
9540 042B 52                 LR    LB,A          SAVE LB
9550 042C 44                 LR    A,MB1         X4MB+CARRY+MB
9560 042D 19                 LNK
9570 042E C1                 AS    MB
9580 042F 51                 LR    MB,A          SAVE MB
9590 0430 43                 LR    A,HB1         X4HB+CARRY+HB
9600 0431 19                 LNK
9610 0432 C0                 AS    HB
9620 0433 50                 LR    HB,A
9630                 *
9640                 * END CONVERSION
9650                 *
9660                 *
9670                 * 20 BIT BINARY TO 6 CHARACTER ASCII CONVERTER
9680                 *
9690                 *
9700 0434 20 38     ASCII    LI    BUFAD
9710 0436 0B                 LR    IS,A
9720 0437 20 30              LI    C'0'          ASCII 0
9730 0439 5D        CLX      LR    I,A           CLEAR BUFFER
9740 043A 8F FE              BR7   CLX
9750 043C 20 38              LI    BUFAD
9760 043E 0B                 LR    IS,A          INIT ISAR
9770                 *
9780 043F 40                 LR    A,HB          MASK OVERFLOW
9790 0440 21 0F              NI    H'0F'
```

```
 9800 0442 50                LR    HB,A          PUT IT BACK
 9810                 *
 9820 0443 40         TOP    LR    A,HB          LOADHI BYTE
 9830 0444 25 01             CI    H'01'         COMPARE
 9840 0446 84 05             BZ    MED           IF EQUAL, CHECK MIDDLE BYTE
 9850 0448 92 11             BNC   INCR          IF LARGER, INCR. DIGIT
 9860 044A 82 22             BC    NEXT          IF SMALLER, DO NEXT DIGIT
 9870 044C 41         MED    LR    A,MB          LOAD MIDDLE BYTE
 9880 044D 25 86             CI    H'86'         COMPARE
 9890 044F 84 05             BZ    LOW           IF EQUAL, CHECK LO BYTE
 9900 0451 92 08             BNC   INCR          IF LARGER, INCREMENT DIGIT
 9910 0453 82 19             BC    NEXT          IF SMALLER, GO TO NEXT DIGIT
 9920 0455 42         LOW    LR    A,LB          LOAD LOW BYTE
 9930 0456 25 9F             CI    H'9F'         COMPARE
 9940 0458 82 14             BC    NEXT          IF SMALLER,GO TO NEXT DIGIT
 9950                 *
 9960                 *  INCREMENT DIGIT
 9970                 *
 9980 045A 4C         INCR   LR    A,S           LOAD DIGIT
 9990 045B 1F                INC                 INCREMENT
10000 045C 5C                LR    S,A           SAVE DIGIT
10010                 *
10020                 * TRIPLE BYTE SUBTRACT 100000
10030                 *
10040 045D 42                LR    A,LB          LOW BYTE
10050 045E 24 60             AI    H'60'         SUBTRACT
10060 0460 52                LR    LB,A          SAVE
10070 0461 41                LR    A,MB          MIDDLE BYTE
10080 0462 19                LNK                 ADD CARRY
10090 0463 24 79             AI    H'79'         SUBTRACT
10100 0465 51                LR    MB,A          SAVE
10110 0466 40                LR    A,HB          HI BYTE
10120 0467 19                LNK                 ADD CARRY
10130 0468 24 FE             AI    H'FE'         SUBTRACT
10140 046A 50                LR    HB,A          SAVE
10150 046B 90 D7             BR    TOP           GO BACK FOR ANOTHER COMPARE
10160                 *
10170                 *
10180                 *  DOUBLE BYTE COMPARE
10190                 *
10200 046D 4D        NEXT   LR    A,I           INCREMENT ISAR
10210 046E 40        NXT1   LR    A,HB          CHECK HB
10220 046F 25 01            CI    1
10230 0471 84 0F            BZ    INC1          IF 1, INCREMENT DIGIT
10240 0473 41               LR    A,MB          LOAD HI BYTE
10250 0474 25 27            CI    H'27'         COMPARE
10260 0476 84 05            BZ    *+6           IF EQUAL, CHECK LOW BYTE
10270 0478 92 08            BNC   *+9           IF LARGER, INCREMENT DIGIT
10280 047A 82 1A            BC    NXT8          IF SMALLER, GO TO NEXT DIGIT
10290 047C 42               LR    A,LB          LOAD LOW BYTE
10300 047D 25 0F            CI    H'0F'         COMPARE
10310 047F 82 15            BC    NXT8          IF SMALLER, GO TO NEXT DIGIT
10320                 *
10330                 *  INCREMENT DIGIT
10340                 *
10350 0481 4C        INC1   LR    A,S           LOAD DIGIT
10360 0482 24 01            AI    1             ADD 1
10370 0484 5C               LR    S,A           PUT IT BACK
10380                 *
10390                 *  DOUBLE BYTE SUBTRACT
10400                 *
10410 0485 42               LR    A,LB          FETCH LOW BYTE
10420 0486 24 F0            AI    H'F0'
10430 0488 52               LR    LB,A          PUT IT BACK
10440 0489 41               LR    A,MB          FETCH HI BYT~E
10450 048A 19               LNK                 ADD CARRY
10460 048B 24 D8            AI    H'D8'
10470 048D 51               LR    MB,A          PUT HI BYTE BACK
10480 048E 40               LR    A,HB          SUBTRACT FROM HB
10490 048F 19               LNK
```

```
10500 0490 24 FF              AI    H'FF'
10510 0492 50                 LR    HB,A          SAVE
10520 0493 90 DA              BR    NXT1          GO BACK AND TEST
10530                 *
10540                 *
10550                 *  SECOND DIGIT CONVERSION
10560                 *
10570                 *  DOUBLE BYTE COMPARE
10580                 *
10590 0495 4D         NXT8    LR    A,I           INCREMENT ISAR
10600 0496 41                 LR    A,MB          LOAD HI BYTE
10610 0497 25 03              CI    H'03'
10620 0499 84 05              BZ    *+6           IF EQUAL, CHECK LOW BYTE
10630 049B 92 08              BNC   *+9           IF LARGER, INCREMENT DIGIT
10640 049D 82 15              BC    *+22
10650 049F 42                 LR    A,LB          LOAD LOW BYTE
10660 04A0 25 E7              CI    H'E7'
10670 04A2 82 10              BC    *+17
10680                 *
10690                 *  INCREMENT DIGIT
10700                 *
10710 04A4 4C                 LR    A,S
10720 04A5 24 01              AI    1             ADD 1
10730 04A7 5C                 LR    S,A
10740                 *
10750                 *  DOUBLE BYTE SUBTRACT
10760                 *
10770 04A8 42                 LR    A,LB          FETCH LOW BYTE
10780 04A9 24 18              AI    H'18'
10790 04AB 52                 LR    LB,A          PUT IT BACK
10800 04AC 41                 LR    A,MB          FETCH HI BYT~E
10810 04AD 19                 LNK                 ADD CARRY
10820 04AE 24 FC              AI    H'FC'
10830 04B0 51                 LR    MB,A          PUT HI BYTE BACK
10840 04B1 90 E4              BR    *-27          GO BACK AND TEST
10850                 *
10860                 *
10870                 *  THIRD DIGIT CONVERSION
10880                 *
10890                 *  DOUBLE BYTE COMPARE
10900                 *
10910 04B3 4D                 LR    A,I           INCREMENT ISAR
10920 04B4 41                 LR    A,MB          LOAD HI BYTE
10930 04B5 25 00              CI    0
10940 04B7 84 05              BZ    *+6           IF EQUAL, CHECK LOW BYTE
10950 04B9 92 08              BNC   *+9
10960 04BB 82 15              BC    *+22
10970 04BD 42                 LR    A,LB          LOAD LOW BYTE
10980 04BE 25 63              CI    H'63'
10990 04C0 82 10              BC    *+17
11000                 *
11010                 *  INCREMENT DIGIT
11020                 *
11030 04C2 4C                 LR    A,S
11040 04C3 24 01              AI    1             ADD 1
11050 04C5 5C                 LR    S,A
11060                 *
11070                 *  DOUBLE BYTE SUBTRACT
11080                 *
11090 04C6 42                 LR    A,LB          FETCH LOW BYTE
11100 04C7 24 9C              AI    H'9C'
11110 04C9 52                 LR    LB,A          PUT IT BACK
11120 04CA 41                 LR    A,MB          FETCH HI BYT~E
11130 04CB 19                 LNK                 ADD CARRY
11140 04CC 24 FF              AI    H'FF'
11150 04CE 51                 LR    MB,A          PUT HI BYTE BACK
11160 04CF 90 E4              BR    *-27          GO BACK AND TEST
11170                 *
11180                 *
11190                 *  FOURTH DIGIT CONVERSION
```

```
11200                   *
11210                   *  DOUBLE BYTE COMPARE
11220                   *
11230 04D1 4D                   LR    A,I              INCREMENT ISAR
11240 04D2 42                   LR    A,LB             LOAD LOW BYTE
11250 04D3 25 09                CI    H'09'
11260 04D5 82 10                BC    *+17
11270                   *
11280                   *  INCREMENT DIGIT
11290                   *
11300 04D7 4C                   LR    A,S
11310 04D8 24 01                AI    1                ADD 1
11320 04DA 5C                   LR    S,A
11330                   *
11340                   *  DOUBLE BYTE SUBTRACT
11350                   *
11360 04DB 42                   LR    A,LB             FETCH LOW BYTE
11370 04DC 24 F6                AI    H'F6'
11380 04DE 52                   LR    LB,A             PUT IT BACK
11390 04DF 41                   LR    A,MB             FETCH HI BYT~E
11400 04E0 19                   LNK                    ADD CARRY
11410 04E1 24 FF                AI    H'FF'
11420 04E3 51                   LR    MB,A             PUT HI BYTE BACK
11430 04E4 90 ED                BR    *-18             GO BACK TO TEST
11440                   *
11450                   *
11460                   *  FINAL DIGIT CONVERSION
11470                   *
11480                   *
11490 04E6 4D                   LR    A,I              INCREMENT ISAR
11500 04E7 42                   LR    A,LB             FETCH REMAINDER
11510 04E8 22 30                OI    H'30'            MAKE IT AN ASCII CHAR.
11520 04EA 5C                   LR    S,A             STORE IN LSD
11530 04EB 1C                   POP                    END SUBROUTINE
11540                   *
11550                   *
11560 04EC 20 11        PRTLN   LI    H'11'            DIR = TRUE (LEFT) CHRP=1
11570 04EE 50                   LR    DIR,A
11580 04EF 71                   LIS   1
11590 04F0 51                   LR    LINE,A           LINE = 1
11600 04F1 70                   CLR
11610 04F2 52                   LR    DOT,A            DOT = 0
11620 04F3 56                   LR    PRFLG,A          PRFLG = FALSE
11630 04F4 74                   LIS   4                ROW = 4
11640 04F5 53                   LR    ROW,A
11650 04F6 71                   LIS   1                CHR=1
11660 04F7 57                   LR    CHR,A
11670                   *
11680                   * SELECT P1 DOTS
11690                   *
11700 04F8 70           SEL1    CLR
11710 04F9 54                   LR    STOR1,A          CLEAR DOT STORAGE
11720 04FA 55                   LR    STOR2,A
11730 04FB 45           LOOP    LR    A,STOR2          SHIFT DOTS
11740 04FC 13                   SL    1
11750 04FD 55                   LR    STOR2,A
11760 04FE 44                   LR    A,STOR1          CHECK FOR DOT CARRY
11770 04FF 21 80                NI    H'80'
11780 0501 84 05                BZ    SKIP
11790 0503 45                   LR    A,STOR2          ADD 1
11800 0504 22 01                OI    1
11810 0506 55                   LR    STOR2,A          SAVE
11820 0507 44           SKIP    LR    A,STOR1          SHIFT
11830 0508 13                   SL    1
11840 0509 54                   LR    STOR1,A
11850                   *
11860                   *  GET A DOT
11870                   *
11880 050A 2A 06 19             DCI   BASE             POINT TO DOT TABLE
11890 050D 43                   LR    A,ROW            GET ROW
```

```
11900 050E 15                SL    4              X16
11910 050F 8E                ADC                  ADD X64
11920 0510 8E                ADC
11930 0511 8E                ADC
11940 0512 8E                ADC                  ADD
11950 0513 47                LR    A,CHR          ADDRESS BUFFER
11960 0514 18                COM                  2'S COMPLEMENT
11970 0515 24 01             AI    1
11980 0517 24 15             AI    21             SUBTRACT FROM 21
11990 0519 24 10             AI    ADDR
12000 051B 0B                LR    IS,A           TRANSFER TO ISAR
12010 051C 4C                LR    A,S            GET CHARACTER
12020 051D 21 3F             NI    H'3F'          MASK TO MAKE CHAR. INDEX
12030 051F 8E                ADC                  DC = BASE+ROW+CHAR. INDEX
12040 0520 16                LM                   GET DOTS
12050 0521 F1                NS    LINE           MASK FOR DOT
12060 0522 84 05             BZ    SKP            IF OFF, SKIP
12070 0524 44                LR    A,STOR1        LSB = 1 OF DOTS
12080 0525 22 01             OI    1
12090 0527 54                LR    STOR1,A        SAVE
12100 0528 47        SKP     LR    A,CHR          INCR CHR
12110 0529 24 02             AI    2
12120 052B 57                LR    CHR,A
12130 052C 25 14             CI    20
12140 052E 82 CC             BC    LOOP           NO; LOOP
12150                *
12160                * TURN DOTS OFF
12170                *
12180 0530 20 FF     SKP1    LI    H'FF'
12190 0532 B0                OUTS  PDOTL
12200 0533 B1                OUTS  PDOTH
12210                *
12220                *  CHECK PRINT FLAG
12230                *
12240 0534 46                LR    A,PRFLG
12250 0535 21 FF             NI    H'FF'
12260 0537 94 0B             BNZ   ST2            SKIP IF ON
12270                *
12280                * TURN MOTOR ON
12290                *
12300 0539 20 C0             LI    MOTON
12310 053B B5                OUTS  PMOT
12320 053C A4        ST1     INS   PORT           CHECK FOR PRINT START
12330 053D 21 01             NI    MPSTRT
12340 053F 84 FC             BZ    ST1            WAIT
12350 0541 7F                LIS   15             PRINT FLAG = TRUE
12360 0542 56                LR    PRFLG,A
12370                *
12380 0543 A4        ST2     INS   PORT           WAIT FOR STROBE P1
12390 0544 21 02             NI    MSTP1
12400 0546 84 FC             BZ    ST2
12410                *
12420 0548 42                LR    A,DOT          INCREMENT DOT COUNTER
12430 0549 1F                INC
12440 054A 52                LR    DOT,A
12450                *
12460 054B 44                LR    A,STOR1        ENERGISE DOTS
12470 054C 18                COM
12480 054D B0                OUTS  PDOTL
12490 054E 45                LR    A,STOR2
12500 054F 18                COM
12510 0550 B1                OUTS  PDOTH
12520                *
12530 0551 40                LR    A,DIR          CHECK DIR
12540 0552 21 01             NI    1
12550 0554 84 0E             BZ    RIG
12560 0556 33                DS    ROW            DECREMENT ROW
12570 0557 82 1A             BC    RIGX           RESET CHR
12580 0559 74                LIS   4              RESET ROW
12590 055A 53                LR    ROW,A
```

```
12600 055B 40                LR    A,DIR          CHRP=2
12610 055C 21 0F             NI    H'0F'
12620 055E 22 20             OI    H'20'
12630 0560 50                LR    DIR,A
12640 0561 90 10             BR    RIGX
12650 0563 43        RIG     LR    A,ROW          INCR ROW
12660 0564 1F                INC
12670 0565 53                LR    ROW,A
12680 0566 25 04             CI    4
12690 0568 82 09             BC    RIGX           IF NOT TOO BIG, SKIP
12700 056A 70                CLR                  ROW = 0
12710 056B 53                LR    ROW,A
12720 056C 40                LR    A,DIR          CHRP=1
12730 056D 21 0F             NI    H'0F'
12740 056F 22 10             OI    H'10'
12750 0571 50                LR    DIR,A
12760 0572 40        RIGX    LR    A,DIR
12770 0573 14                SR    4              RESET CHR
12780 0574 57                LR    CHR,A
12790                *
12800                *
12810                *  SELECT P2 DOTS
12820                *
12830 0575 70                CLR
12840 0576 54                LR    STOR1,A        CLEAR DOT STORAGE
12850 0577 55                LR    STOR2,A
12860 0578 45        LOP1    LR    A,STOR2        SHIFT DOTS
12870 0579 13                SL    1
12880 057A 55                LR    STOR2,A
12890 057B 44                LR    A,STOR1        CHECK FOR DOT CARRY
12900 057C 21 80             NI    H'80'
12910 057E 84 05             BZ    SKPP
12920 0580 45                LR    A,STOR2        ADD 1
12930 0581 22 01             OI    1
12940 0583 55                LR    STOR2,A        SAVE
12950 0584 44        SKPP    LR    A,STOR1        SHIFT
12960 0585 13                SL    1
12970 0586 54                LR    STOR1,A
12980                *
12990                *  GET A DOT
13000                *
13010 0587 2A 06 19          DCI   BASE           POINT TO DOT TABLE
13020 058A 43                LR    A,ROW          GET ROW
13030 058B 15                SL    4              X16
13040 058C 8E                ADC                  ADD X64
13050 058D 8E                ADC
13060 058E 8E                ADC
13070 058F 8E                ADC                  ADD
13080 0590 47                LR    A,CHR          ADDRESS BUFFER
13090 0591 18                COM
13100 0592 24 01             AI    1
13110 0594 24 15             AI    21
13120 0596 24 10             AI    ADDR
13130 0598 0B                LR    IS,A           TRANSFER TO ISAR
13140 0599 4C                LR    A,S            GET CHARACTER
13150 059A 21 3F             NI    H'3F'          MASK TO MAKE CHAR. INDEX
13160 059C 8E                ADC                  DC = BASE+ROW+CHAR. INDEX
13170 059D 16                LM                   GET DOTS
13180 059E F1                NS    LINE           MASK FOR DOT
13190 059F 84 05             BZ    SKX            IF OFF, SKIP
13200 05A1 44                LR    A,STOR1        LSB = 1 OF DOTS
13210 05A2 22 01             OI    1
13220 05A4 54                LR    STOR1,A        SAVE
13230 05A5 47        SKX     LR    A,CHR          INDR BY 2
13240 05A6 24 02             AI    2
13250 05A8 57                LR    CHR,A
13260 05A9 25 14             CI    20
13270 05AB 82 CC             BC    LOP1           NO; LOP1
13280                *
13290                * CLEAR DOTS
```

```
13300                 *
13310 05AD 20 FF      SKX1     LI     H'FF'
13320 05AF B0                  OUTS   PDOTL
13330 05B0 B1                  OUTS   PDOTH
13340                 *
13350 05B1 A4         ST3      INS    PORT          CHECK STROBE P2
13360 05B2 21 04               NI     MSTP2
13370 05B4 84 FC               BZ     ST3
13380                 *
13390 05B6 42                  LR     A,DOT         INCREMENT DOT COUNTER
13400 05B7 1F                  INC
13410 05B8 52                  LR     DOT,A
13420                 *
13430 05B9 44                  LR     A,STOR1       ENERGIZE DOTS
13440 05BA 18                  COM
13450 05BB B0                  OUTS   PDOTL
13460 05BC 45                  LR     A,STOR2
13470 05BD 18                  COM
13480 05BE B1                  OUTS   PDOTH
13490                 *
13500                 *
13510                 * CHECK DIRECTION
13520                 *
13530 05BF 40                  LR     A,DIR
13540 05C0 21 01               NI     1
13550 05C2 94 0F               BNZ    LEFT
13560 05C4 43                  LR     A,ROW         INCREMENT ROW
13570 05C5 1F                  INC
13580 05C6 53                  LR     ROW,A
13590 05C7 25 04               CI     4             ROW > 4?
13600 05C9 82 13               BC     REPL          NO,GO BACK
13610 05CB 74                  LIS    4
13620 05CC 53                  LR     ROW,A         ROW = 5
13630 05CD 20 11               LI     H'11'         CHRP = 1, DIR = 1 LEFT
13640 05CF 50                  LR     DIR,A         DIR = 1 (LEFT)
13650 05D0 90 09               BR     SHIFT         DO LINE SHIFT
13660                 *
13670 05D2 33         LEFT     DS     ROW           DECREMENT ROW COUNTER
13680 05D3 82 09               BC     REPL          GO BACK IF NOT 0
13690 05D5 70                  CLR                  ROW = 0
13700 05D6 53                  LR     ROW,A
13710 05D7 20 20               LI     H'20'         DIR = RIGHT, CHRP=2
13720 05D9 50                  LR     DIR,A
13730 05DA 41         SHIFT    LR     A,LINE        SHIFT LINE MASK
13740 05DB 13                  SL     1
13750 05DC 51                  LR     LINE,A
13760 05DD 40         REPL     LR     A,DIR         SET CHR
13770 05DE 14                  SR     4
13780 05DF 57                  LR     CHR,A         CHR = CHRP
13790                 *
13800                 * CHECK FOR END OF LINE
13810                 *
13820 05E0 42         SEL3     LR     A,DOT
13830 05E1 25 46               CI     70            DOT = 70?
13840 05E3 84 04               BZ     SPACE         DO SPACES
13850                 *
13860 05E5 29 04 F8            JMP    SEL1          RETURN TO TOP
13870                 *
13880                 * DO SPACING BETWEEN LINES
13890                 *
13900 05E8 20 87      SPACE    LI     135           WAIT 2.4 MS. FOR THERMAL
13910 05EA 2B         SPI      NOP                  ELEMENTS
13920 05EB 2B                  NOP
13930 05EC 2B                  NOP
13940 05ED 1F                  INC
13950 05EE 94 FB               BNZ    SPI
13960                 *
13970 05F0 20 FF               LI     H'FF'         TURN DOTS OFF
13980 05F2 B0                  OUTS   PDOTL
13990 05F3 B1                  OUTS   PDOTH
```

```
14000                   *
14010 05F4 A4           SPACE1   INS   PORT          WAIT FOR STROBE P1
14020 05F5 21 02                 NI    MSTP1
14030 05F7 84 F0                 BZ    SPACE
14040                   *
14050                   * INCREMENT DOT COUNTER
14060                   *
14070 05F9 42                    LR    A,DOT
14080 05FA 1F                    INC
14090 05FB 52                    LR    DOT,A
14100                   *
14110                   * WAIT FOR STROBE P2
14120                   *
14130 05FC A4           ST5      INS   PORT
14140 05FD 21 04                 NI    MSTP2
14150 05FF 84 FC                 BZ    ST5
14160                   *
14170                   * INCREMENT DOT COUNTER
14180                   *
14190 0601 42                    LR    A,DOT
14200 0602 1F                    INC
14210 0603 52                    LR    DOT,A
14220                   *
14230 0604 25 5A                 CI    90            DOTS = 90?
14240 0606 94 ED                 BNZ   SPACE1        NO; DO MORE SPACE
14250                   *
14260                   * TURN OFF MOTOR
14270                   *
14280 0608 20 40                 LI    MOTOF
14290 060A B5                    OUTS  PMOT
14300                   *
14310                   *  CLEAR BUFFER
14320                   *
14330 060B 20 14        CLEAR    LI    20            20 CHAR. IN BUFFER
14340 060D 50                    LR    CNT,A
14350 060E 40           CL1      LR    A,CNT         GET CHAR. NO.
14360 060F 24 10                 AI    ADDR          BUFFER OFFSET
14370 0611 0B                    LR    IS,A
14380 0612 20 20                 LI    H'20'         SPACE
14390 0614 5C                    LR    S,A           SAVE IN BUFFER
14400 0615 30                    DS    CNT           DECREMENT CHAR. COUNTER
14410 0616 94 F7                 BNZ   CL1
14420 0618 1C                    POP                 RETURN
14430                   *
14440                   *
14450                   *  DOT PATTERNS
14460                   *
14470                   * COLUMN 1
14480                   *
14490                   * @-G
14500 0619 3E 7E        BASE     DC    H'3E7E'
14510 061B 7F 3E                 DC    H'7F3E'
14520 061D 7F 7F                 DC    H'7F7F'
14530 061F 7F 3E                 DC    H'7F3E'
14540                   * H-O
14550 0621 7F 00                 DC    H'7F00'
14560 0623 20 7F                 DC    H'207F'
14570 0625 7F 7F                 DC    H'7F7F'
14580 0627 7F 3E                 DC    H'7F3E'
14590                   * P-W
14600 0629 7F 3E                 DC    H'7F3E'
14610 062B 7F 46                 DC    H'7F46'
14620 062D 01 3F                 DC    H'013F'
14630 062F 07 7F                 DC    H'077F'
14640                   * X-[
14650 0631 63 07                 DC    H'6307'
14660 0633 61 7F                 DC    H'617F'
14670 0635 03 00                 DC    H'0300'
14680 0637 02 40                 DC    H'0240'
14690                   *   -'
```

```
14700 0639 00                DC    H'0000'
14710 063A 00                DC    0
14720 063B 00                DC    0
14730 063C 14                DC    H'0014'
14740 063D 24 63             DC    H'2463'
14750 063F 60 00             DC    H'6000'
14760                 * (-/
14770 0641 00                DC    H'0000'
14780 0642 00                DC    0
14790 0643 14 08             DC    H'1408'
14800 0645 40 08             DC    H'4008'
14810 0647 40 60             DC    H'4060'
14820                 * 0-7
14830 0649 3E 44             DC    H'3E44'
14840 064B 62 41             DC    H'6241'
14850 064D 18 27             DC    H'1827'
14860 064F 3C 01             DC    H'3C01'
14870                 * 8-?
14880 0651 36 46             DC    H'3646'
14890 0653 00                DC    0
14900 0654 40                DC    H'0040'
14910 0655 08 14             DC    H'0814'
14920 0657 41 02             DC    H'4102'
14930                 *
14940                 * COLUMN 1 DOT PATTERNS
14950                 *
14960                 * @-G
14970 0659 41 09             DC    H'4109'
14980 065B 49 41             DC    H'4941'
14990 065D 41 49             DC    H'4149'
15000 065F 09 41             DC    H'0941'
15010                 * H-O
15020 0661 08 41             DC    H'0841'
15030 0663 40 08             DC    H'4008'
15040 0665 40 02             DC    H'4002'
15050 0667 06 41             DC    H'0641'
15060                 * P-W
15070 0669 09 41             DC    H'0941'
15080 066B 09 49             DC    H'0949'
15090 066D 01 40             DC    H'0140'
15100 066F 18 20             DC    H'1820'
15110                 * X-[
15120 0671 14 08             DC    H'1408'
15130 0673 51 41             DC    H'5141'
15140 0675 04 00             DC    H'0400'
15150 0677 01 40             DC    H'0140'
15160                 *  -'
15170 0679 00                DC    H'0000'
15180 067A 00                DC    0
15190 067B 07 7F             DC    H'077F'
15200 067D 2A 13             DC    H'2A13'
15210 067F 4E 04             DC    H'4E04'
15220                 * (-/
15230 0681 1C 41             DC    H'1C41'
15240 0683 08 08             DC    H'0808'
15250 0685 30 08             DC    H'3008'
15260 0687 00                DC    0
15270 0688 10                DC    H'0010'
15280                 * 0-7
15290 0689 51 42             DC    H'5142'
15300 068B 51 41             DC    H'5141'
15310 068D 14 45             DC    H'1445'
15320 068F 4A 71             DC    H'4A71'
15330                 * 8-?
15340 0691 49 49             DC    H'4949'
15350 0693 00                DC    0
15360 0694 34                DC    H'0034'
15370 0695 14 14             DC    H'1414'
15380 0697 41 01             DC    H'4101'
15390                 *
```

```
15400                   * DOT PATTERNS FOR COLUMN 2
15410                   *
15420                   * @-G
15430 0699 5D 09                DC     H'5D09'
15440 069B 49 41                DC     H'4941'
15450 069D 41 49                DC     H'4149'
15460 069F 09 41                DC     H'0941'
15470                   * H-O
15480 06A1 08 7F                DC     H'087F'
15490 06A3 41 14                DC     H'4114'
15500 06A5 40 0C                DC     H'400C'
15510 06A7 08 41                DC     H'0841'
15520                   * P-W
15530 06A9 09 51                DC     H'0951'
15540 06AB 19 49                DC     H'1949'
15550 06AD 7F 40                DC     H'7F40'
15560 06AF 60 18                DC     H'6018'
15570                   * X-[
15580 06B1 08 78                DC     H'0878'
15590 06B3 49 41                DC     H'4941'
15600 06B5 08 41                DC     H'0841'
15610 06B7 01 40                DC     H'0140'
15620                   *  -'
15630 06B9 00                   DC     0
15640 06BA 4F                   DC     H'004F'
15650 06BB 00                   DC     0
15660 06BC 14                   DC     H'0014'
15670 06BD 7F 08                DC     H'7F08'
15680 06BF 59 02                DC     H'5902'
15690                   * (-/
15700 06C1 22 22                DC     H'2222'
15710 06C3 3E 3E                DC     H'3E3E'
15720 06C5 00                   DC     0
15730 06C6 08                   DC     H'0008'
15740 06C7 00                   DC     0
15750 06C8 08                   DC     H'0008'
15760                   * 0-7
15770 06C9 49 7F                DC     H'497F'
15780 06CB 51 49                DC     H'5149'
15790 06CD 12 45                DC     H'1245'
15800 06CF 49 09                DC     H'4909'
15810                   * 8-?
15820 06D1 49 49                DC     H'4949'
15830 06D3 44 00                DC     H'4400'
15840 06D5 22 14                DC     H'2214'
15850 06D7 22 51                DC     H'2251'
15860                   *
15870                   * DOT PATTERNS COLUMN 3
15880                   *
15890                   * @-G
15900 06D9 55 09                DC     H'5509'
15910 06DB 49 41                DC     H'4941'
15920 06DD 22 49                DC     H'2249'
15930 06DF 09 49                DC     H'0949'
15940                   * H-O
15950 06E1 08 41                DC     H'0841'
15960 06E3 3F 22                DC     H'3F22'
15970 06E5 40 02                DC     H'4002'
15980 06E7 30 41                DC     H'3041'
15990                   * P-W
16000 06E9 09 21                DC     H'0921'
16010 06EB 29 49                DC     H'2949'
16020 06ED 01 40                DC     H'0140'
16030 06EF 18 20                DC     H'1820'
16040                   * X-[
16050 06F1 14 08                DC     H'1408'
16060 06F3 45 00                DC     H'4500'
16070 06F5 10 41                DC     H'1041'
16080 06F7 01 40                DC     H'0140'
16090                   *  -'
```

```
16100 06F9 00                DC    H'0000'
16110 06FA 00                DC    0
16120 06FB 07 7F             DC    H'077F'
16130 06FD 2A 64             DC    H'2A64'
16140 06FF 26 01             DC    H'2601'
16150                 * (-/
16160 0701 41 1C             DC    H'411C'
16170 0703 08 08             DC    H'0808'
16180 0705 00                DC    0
16190 0706 08                DC    H'0008'
16200 0707 00                DC    0
16210 0708 04                DC    H'0004'
16220                 * 0-7
16230 0709 45 40             DC    H'4540'
16240 070B 49 55             DC    H'4955'
16250 070D 7F 45             DC    H'7F45'
16260 070F 49 05             DC    H'4905'
16270                 * 8-?
16280 0711 49 29             DC    H'4929'
16290 0713 00                DC    0
16300 0714 00                DC    H'0000'
16310 0715 41 14             DC    H'4114'
16320 0717 14 09             DC    H'1409'
16330                 *
16340                 * DOT PATTERNS COLUMN 4
16350                 *
16360                 * @-G
16370 0719 1E 7E             DC    H'1E7E'
16380 071B 36 22             DC    H'3622'
16390 071D 1C 41             DC    H'1C41'
16400 071F 01 7A             DC    H'017A'
16410                 * H-O
16420 0721 7F 00             DC    H'7F00'
16430 0723 01 41             DC    H'0141'
16440 0725 40 7F             DC    H'407F'
16450 0727 7F 3E             DC    H'7F3E'
16460                 * P-W
16470 0729 06 5E             DC    H'065E'
16480 072B 46 31             DC    H'4631'
16490 072D 01 3F             DC    H'013F'
16500 072F 07 7F             DC    H'077F'
16510                 * X-[
16520 0731 63 07             DC    H'6307'
16530 0733 43 00             DC    H'4300'
16540 0735 60 7F             DC    H'607F'
16550 0737 02 40             DC    H'0240'
16560                 *  -'
16570 0739 00                DC    H'0000'
16580 073A 00                DC    0
16590 073B 00                DC    0
16600 073C 14                DC    H'0014'
16610 073D 12 63             DC    H'1263'
16620 073F 50 00             DC    H'5000'
16630                 * (-/
16640 0741 00                DC    H'0000'
16650 0742 00                DC    0
16660 0743 14 08             DC    H'1408'
16670 0745 00                DC    0
16680 0746 08                DC    H'0008'
16690 0747 00                DC    0
16700 0748 03                DC    H'0003'
16710                 * 0-7
16720 0749 3E 40             DC    H'3E40'
16730 074B 46 22             DC    H'4622'
16740 074D 10 39             DC    H'1039'
16750 074F 31 03             DC    H'3103'
16760                 * 8-?
16770 0751 36 1E             DC    H'361E'
16780 0753 00                DC    0
16790 0754 00                DC    H'0000'
```

```
16800 0755 41 14                DC    H'4114'
16810 0757 08 06                DC    H'0806'
16820                   *
16830 0759 4E           HBUF1   DC    C'N'
16840 075A 41                   DC    C'A'
16850 075B 54                   DC    C'T'
16860 075C 49                   DC    C'I'
16870 075D 4F                   DC    C'O'
16880 075E 4E                   DC    C'N'
16890 075F 41                   DC    C'A'
16900 0760 4C                   DC    C'L'
16910 0761 20                   DC    C' '
16920 0762 52                   DC    C'R'
16930 0763 45                   DC    C'E'
16940 0764 4A                   DC    C'J'
16950 0765 45                   DC    C'E'
16960 0766 43                   DC    C'C'
16970 0767 54                   DC    C'T'
16980 0768 4F                   DC    C'O'
16990 0769 52                   DC    C'R'
17000 076A 53                   DC    C'S'
17010 076B 0D                   DC    H'0D'
17020 076C 44           HBUF2   DC    C'D'
17030 076D 41                   DC    C'A'
17040 076E 54                   DC    C'T'
17050 076F 41                   DC    C'A'
17060 0770 20                   DC    C' '
17070 0771 41                   DC    C'A'
17080 0772 43                   DC    C'C'
17090 0773 51                   DC    C'Q'
17100 0774 55                   DC    C'U'
17110 0775 49                   DC    C'I'
17120 0776 53                   DC    C'S'
17130 0777 49                   DC    C'I'
17140 0778 54                   DC    C'T'
17150 0779 49                   DC    C'I'
17160 077A 4F                   DC    C'O'
17170 077B 4E                   DC    C'N'
17180 077C 0D                   DC    H'0D'
17190 077D 53           HBUF3   DC    C'S'
17200 077E 59                   DC    C'Y'
17210 077F 53                   DC    C'S'
17220 0780 54                   DC    C'T'
17230 0781 45                   DC    C'E'
17240 0782 4D                   DC    C'M'
17250 0783 0D                   DC    H'0D'
17260                   *
              END
NUMBER OF ERRORS=  0

      01B9 ADD    0170 ADDR  =0010 ASCII  0434 A1     0036 A2     005A
BASE   0619 BUFAD =0038 BUFP  =0026 BUF1  =0011 BUF2  =0014 BUF3  =0018
BUF4  =001E BUF5  =0020 CHR   =0007 CK3    0186 CK4    018F CLBUF  00FE
CLEAR  060B CLX    0439 CL1    060E CNT   =0000 CNT1  =0003 CNT2  =0004
CNT3  =0005 DIR   =0000 DLOOP  033C DOT   =0002 DP     03DC DUMP   01C7
ERASE  01AC ER1    01AE ER2    01B6 ER3    01BD HB    =0000 HBUF1  0759
HBUF2  076C HBUF3  077D HB1   =0003 HD1    0400 H1     01D3 IDST  =2000
INCR   045A INC1   0481 LB    =0002 LB1   =0005 LDX2   03E6 LEFT   05D2
LINE  =0001 LOAD2  03F5 LOAD3  03EE LOOP   04FB LOP1   0578 LOW    0455
MAXIT =200B MB    =0001 MB1   =0004 MED    044C MMODE =0020 MODE   001E
MODE1  002B MONTL =2004 MOTOF =0040 MOTON =00C0 MOVA   03C9 MOVA1  03CE
MPSTRT=0001 MSEL  =0010 MSTOP =0040 MSTP1 =0002 MSTP2 =0004 MTOT  =0008
MX1    0339 NEXT   046D NICKL  0410 NXT1   046E NXTS   0495 OVER   0196
PDOTH =0001 PDOTL =0000 PFAIL =200A PMODE =0004 PMOT  =0005 PORT  =0004
PREND  03C6 PRFLG =0006 PRTFL =200C PRTLN  04EC PSEL  =0004 PSW   =0004
PTOT  =0004 READ   0212 REPL   05DD REPX   0163 RIG    0563 RIGX   0572
RMONTL=2007 ROW   =0003 RPL1   01A4 SEL1   04F8 SEL3   05E0 SHIFT  05DA
SKIP   0507 SKP    0528 SKPP   0584 SKP1   0530 SKX    05A5 SKX1   05AD
SPACE  05E8 SPACE1 05F4 SPI    05EA STOP   03D6 STORE =200D STOR1 =0004
STOR2 =0005 ST1    053C ST2    0543 ST3    05B1 ST5    05FC TEMP  =0008
```

```
TIMST =2002 TOP    0443 XA    0226 XB    022F XC    023A XXXX   00A0
X0     021A X1     0062 X10   00AC X11   00B6 X12   00C0 X13    00C2
X131   00C7 X14    00D3 X15   00DA X151  00E5 X16   010B X161   0127
X17    012A X2     006E X3    0078 X4    007A X5    0088 X6     008F
X7     0094 X8     00A3 X9    00A7
```

What we claim is:

1. A data acquisition unit, which is connectable to a money-operated, multi-selection vending machine that responds to the insertion of money to develop credits and that responds to the actuation of selection switches to initiate vending operations, and which comprises a memory having locations in which resettable data can be stored, a connection between said vending machine and said data acquisition unit which enables said vending machine to transmit data to said data acquisition unit, a switch, a data processing means, and a data-receiving device which is connectable to said data acquisition unit to receive data from said acquisition unit, said data processing means normally responding to data transmitted by said vending machine to store said data in said locations in said memory, said data processing means responding to actuation of said switch to place said data acquisition unit in a data-yielding mode wherein said data processing means transfers said data from said data acquisition unit to said data-receiving device, said data processing means acting while said data acquisition unit is in said data-yielding mode to yield said resettable data to said data-receiving device while also retaining said resettable data in said locations in said memory, said data processing means subsequently responding to restoration of said switch to its normal condition and to the transmission of further data from said vending machine to be enabled to clear said resettable data from said locations in said memory.

2. A data acquistion unit as claimed in claim 1 wherein said data processing means is unable, prior to the restoration of said switch to its normal condition, to clear said resettable data from said locations in said memory.

3. A data acquisition unit as claimed in claim 1 wherein said data processing means is unable, prior to the transmission of said further data from said vending machine, to clear said resettable data from said locations in said memory.

4. A data acquisition unit as claimed in claim 1 wherein said data processing means is unable, prior to the restoration of said switch to its normal condition to clear said resettable data from said locations in said memory, and wherein said data processing means is unable, prior to the transmission of said further data from said vending machine to clear said resettable data from said locations in said memory.

5. A data acquisition unit as claimed in claim 1 wherein said memory has further locations therein in which non-resettable data can be stored, and wherein said data processing means retains said non-resettable data in said further memory locations as said data processing means transfers said resettable and said non-resettable data from said data acquisition unit to said data-receiving device.

6. A data acquisition unit, which is connectable to a money-operated, multi-selection vending machine that responds to the insertion of money to develop credits and that responds to the actuation of selection switches to initiate vending operations, and which comprises a memory having locations in which non-resettable running counts corresponding to the numbers of vending operations initiated by the closings of predetermined ones of said selection switches can be stored, said memory having further locations in which resettable running counts corresonding to the number of vending operations initiated by the closings of said predetermined ones of said selection switches can be stored, said memory having still further locations in which non-resettable running counts of the sums of the prices of each of said products which are vended during said vending operations and which correspond to said predetermined ones of said selection switches can be stored, said memory having still further locations in which non-resettable running counts of sums of the prices of each of said products which are vended during said vending operations and which correspond to said predetermined ones of said selection switches can be stored, a data-receiving device to which data that is read from all of said memory locations can be applied, and data processing means that reads data from all of said memory locations and applies said data to said data-receiving device while retaining said non-resettable running counts within said locations of said memory.

7. A data acquisition unit as claimed in claim 6 wherein said data acquisition unit is in a data-yielding mode whenever said data-receiving device is attached to said data acquisition unit, and a switch that initiates said data-yielding mode, wherein said data acquisition unit continues to remain in said data-yielding mode after said data-receiving device has been separated from said data acquisition unit and said switch has been restored to its normal condition, and wherein a subsequent vending operation by said vending machine will take said data acquisition unit out of said data-yielding mode and place it in a data-storing mode.

8. A data acquisition unit as claimed in claim 6 wherein data is transferred from said vending machine to said data acquisition unit each time a vending operation is performed by said vending machine, and wherein said data which said vending machine transfers to said data acquisition unit directly and precisely reflects the selection number of the selection switch used to initiate the vending operation and also directly and precisely identifies the price of the vended product.

9. A data acquisition unit as claimed in claim 6 wherein data is transferred from said vending machine to said data acquisition unit each time a vending operation is performed by said vending machine, wherein the prices at which said vending machine can vend products can be changed from time to time by a route man, and wherein said data which said vending machine transfers to said data acquisition unit directly and precisely reflects the selection number of the selection switch used to initiate the vending operation and also directly and precisely identifies the currently-set price for the vended product.

10. A data acquisition unit, which is connectable to a money-operated, multi-selection vending machine that responds to the insertion of money to develop credits and that responds to the actuation of selection switches to initiate vending operations, and which comprises conductors extending from said data acquisition unit to said vending machine to receive serial bit streams containing digital logic data representing the vending of predetermined products during vending operations initiated by the closing of predetermined ones of said selection switches and also containing further digital logic data representing the prices of said predetermined products vended during said vending operations, a memory having locations in which running counts of the numbers of said predetermined products which are vended during said vending operations initiated by the closings of said predetermined ones of said selection switches can be stored, said memory having further locations in which running counts of the sums of the prices of said predetermined products which are vended during said vending operations can be stored, data processing means responsive to said serial bit streams to sense said digital logic data therein and to identify the selection switches that initiated said vending operations and to address the corresponding memory locations and to increment said running counts of the numbers of said predetermined products which are vended during said vending operations which are initiated by said predetermined ones of said selection switches, said data processing means also addressing the memory locations wherein said running counts of said sums of the prices of said predetermined products which are vended during said vending operations are stored to update said running counts, and a data accepting unit which can accept data from said data acquisition unit.

11. A data acquisition unit as claimed in claim 10 wherein one group of running counts of the number of said predetermined products which are vended during said vending operations initiated by the closings of said predetermined ones of said selection switches is non-resettable, and wherein a further group of running counts of the number of said predetermined products which are vended during said vending operations initiated by the closings of said predetermined ones of said selection switches is resettable.

12. A data acquisition unit as claimed in claim 10 wherein said running counts of said sums of the prices of said predetermined products which are vended during said vending operations are non-resettable.

13. A data acquisition unit as claimed in claim 10 wherein said running counts of said sums of the prices of said predetermined products which are vended during said vending operations are non-resettable, and wherein said memory has a still further location in which a non-resettable running count of the total of the prices of all of the products vended during said vending operations can be stored.

14. A data acquisition unit as claimed in claim 10 wherein said running counts of said sums of the prices of said predetermined products which are vended during said vending operations are non-resettable, wherein said memory has a still further location in which a non-resettable running count of the total of the prices of all of the products vended during said vending operations can be stored, wherein one group of running counts of the number of said predetermined products which are vended during said vending operations initiated by the closings of said predetermined ones of said selection switches is non-resettable, and wherein a further group of running counts of the number of said predetermined products which are vended during said vending operations initiated by the closings of said predetermined ones of said selection switches is resettable.

15. A data acquisition unit, which is connectable to a money-operated, multi-selection vending machine that responds to the insertion of money to develop credits and that responds to the actuation of selection switches to initiate vending operations, and which comprises a memory having locations therein in which digital data can be stored, a connection between said data acquisition unit and said vending machine which causes digital data from said vending machine to be supplied to said data acquisition unit, data processing means that automatically responds to said digital data from said vending machine to store said digital data in locations in said memory, a connector to which a data-accepting unit can be connected to enable data from said locations in said memory to be transferred to said data-accepting unit whenever said data acquisition unit is in a data-transferring mode, a switch that is selectively actuable to place said data acquisition unit in said data-transferring mode, and said data processing means responding to the return of said switch to its normal condition and to the receipt of further digital data from said vending machine to automatically take said data acquisition unit out of said data-transferring mode and to place said data-accepting unit in said data-accepting mode.

16. A data acquisition unit as claimed in claim 15 wherein said data-accepting unit includes a printer, and wherein the actuation of said switch starts a cycle of operation of said printer.

17. A data acquisition unit, which is connectable to a money-operated, multi-selection vending machine that responds to the insertion of money to develop credits and that responds to the actuation of selection switches to initiate vending operations, and which comprises a memory having locations therein in which digital data can be stored, a connection between said data acquisition unit and said vending machine which causes digital data from said vending machine to be supplied to said data acquisition unit, data processing means that automatically responds to said digital data from said vending machine to store said digital data in locations in said memory, a connection between a data-accepting unit and said data acquisition unit which enables data from said locations in said memory to be transferred to said data-accepting unit to provide a printout bearing running counts based on said digital data while said data acquisition unit is in a data-transferring mode, and a switch that is selectively actuatable to place said data acquisition unit in said data-transferring mode, said data-accepting unit being adapted to provide said printout bearing said running counts based on said digital data while said data acquisition unit is in said data-transferring mode, said data acquisition unit retaining all of said digital data in said locations while said printout is being printed, whereby said data acquisition unit can again supply said digital data to said data-accepting unit while said data acquisition unit is in said data-transferring mode so said data-accepting unit can provide further and identical printouts bearing said running counts based on said digital data while said data acquisition unit is in said data-transferring mode.

18. A data acquisition unit, which is connectable to a money-operated, multi-selection vending machine that responds to the insertion of money to develop credits and that responds to the actuation of selection switches to initiate vending operations, and which comprises conductors extending from said data acquisition unit to said vending machine to receive serial bit streams containing digital logic data representing the vending of predetermined products during vending operations initiated by the closing of predetermined ones of said selection switches and also containing further digital logic data representing the prices of said predetermined products vended during said vending operations, a memory having locations in which non-resettable running counts of the numbers of said predetermined products which are vended during said vending operations initiated by the closing of said predetermined ones of said selection switches can be stored, said memory having another location in which a non-resettable running count of the total of the prices of all of the products vended during said vending operations can be stored, said memory having yet another location in which a resettable running count of the total of the prices of all of the products vended during said vending operations can be stored, data processing means responsive to said serial bit streams to sense said digital logic data therein and to identify the selection switches that initiated said vending operations and to address the corresponding memory locations and to increment said running counts of the numbers of said predetermined products which are vended during said vending operations initiated by said predetermined ones of said selection switches, said data processing means also addressing the memory locations wherein said running counts of the total of the prices of all of the products vended during said vending operations are stored to update said running counts, and a data accepting unit which can accept data from said data acquisition unit.

19. A data acquisition unit, which is connectable to a money-operated, multi-selection vending machine that responds to the insertion of money to develop credits and that responds to the actuation of selection switches to initiate vending operations, and which comprises a memory having locations in which digital logic data can be stored whenever said data acquisition unit is in a data-accepting mode, a connector that can connect said data acquisition unit to a data-receiving unit whenever said data acquisition unit is in a data-yielding mode, a selectively-actuable switch that can be actuated to place said data acquisition unit in said data-yielding mode, said data acquisition unit responding to the termination of said actuation of said switch and to the receipt of data from said vending machine to automatically shift out of said data-yielding mode and into said data-receiving mode.

20. A data acquisition unit, which is connectable to a money-operated, multi-selection vending machine that responds to the insertion of money to develop credits and that responds to the actuation of selection switches to initiate vending operations, and which comprises conductors extending from said data acquisition unit to said vending machine to receive serial bit streams containing digital logic data representing vending operations initiated by the closing of said selection switches and also containing further digital logic data representing the prices of products vended during said vending operations, a memory having locations in which running counts of the number of vending operations initiated by the closings of said selection switches can be stored, said memory having a further location in which a running count of the prices of the products vended during said vending operations can be stored, data processing means responsive to said serial bit streams to sense said digital logic data therein and to identify the selection switches that initiated said vending operations and to address the corresponding memory locations and to increment said running counts of the numbers of vending operations initiated by said selection switches, said data processing means also addressing the memory location wherein said running count of the prices of the products vended during said vending operations is stored to update said running count, said memory having another location wherein a number, which corresponds to the highest-number selection switch that has been actuated, is stored, wherein said data processing means compares the number of each actuated selection switch with said number in said other memory location and then re-writes the number which is in said other memory location in the event the number of the last actuated selection switch is larger than said number in said other memory location, whereby said number in said other memory location always represents the number of the highest-number selection switch that has been actuated.

21. A data acquisition unit as claimed in claim 20 wherein a data accepting unit which can accept data from said data acquisition unit is connectable to said data acquisition unit, wherein said data-accepting unit can provide a print out, and wherein said print out will not include entires for any selection switches that have numbers higher than the number of the highest-number selection switch that has been actuated.

* * * * *